US007130568B2

(12) United States Patent
Mochizuki

(10) Patent No.: US 7,130,568 B2
(45) Date of Patent: Oct. 31, 2006

(54) IMAGE FORMING APPARATUS WHICH PRESENTS FAULTY IMAGE WHEN TONER IMAGE ON IMAGE BEARING MEMBER IS TRANSFERRED TO TRANSFERRING MEDIUM

(75) Inventor: Jun Mochizuki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/011,169

(22) Filed: Dec. 15, 2004

(65) Prior Publication Data

US 2005/0141929 A1 Jun. 30, 2005

(30) Foreign Application Priority Data

Dec. 24, 2003 (JP) ..... 2003-428476

(51) Int. Cl.
*G03G 15/01* (2006.01)

(52) U.S. Cl. ..... 399/298; 399/299; 399/300; 399/303; 399/313; 399/314; 399/315; 399/39; 399/66

(58) Field of Classification Search ..... 399/298, 399/299, 300, 303, 313–315
See application file for complete search history.

(56) References Cited

U.S. PATENT DOCUMENTS 5,600,421 A * 2/1997 Takekoshi et al. ..... 399/66
5,778,291 A * 7/1998 Okubo et al. ..... 399/302
5,991,870 A 11/1999 Koumura et al. ..... 712/208
6,081,678 A * 6/2000 Kato ..... 399/49
6,922,542 B1 * 7/2005 Mizuno et al. ..... 399/302
2002/0159801 A1 * 10/2002 Nakashima et al. ..... 399/307
2003/0039479 A1 * 2/2003 Takahashi ..... 399/66
2003/0175041 A1 * 9/2003 Taguchi et al. ..... 399/66
2003/0185601 A1 * 10/2003 Toyohara et al. ..... 399/298

(Continued)

FOREIGN PATENT DOCUMENTS

JP 9-152971 6/1997

(Continued)

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

In an Image forming apparatus, a light color toner image forming unit that forms a light color toner image on a transfer medium has a first developing device which develops an electrostatic image on a first image bearing member to form the light color toner image on the first image bearing member. A first transfer member electrostatically transfers the light color toner image to the transferring medium member by abutting against the first image bearing member with the transferring member in a first abutting position. A deep color toner image forming unit that forms a deep color toner image on a transferring medium has a second developing device which develops an electrostatic image on a second image bearing member in a second developing portion to form the deep color image on the second image bearing member. A second transferring member electrostatically transfers the deep color toner image to the transferring medium by abutting against the second image bearing member with the transferring member arranged so that the rotational direction distance of the first image bearing member between the second developing potion and the second abutting portion is longer than the rotational direction distance of the first image bearing member between the first developing portion and the first abutting potion and so that the deep color toner image forming unit is arranged upstream of the transferring medium moving direction with respect to the light color toner image forming unit.

14 Claims, 18 Drawing Sheets

U.S. PATENT DOCUMENTS

| | | | | |
|---|---|---|---|---|
| 2004/0062561 | A1 | 4/2004 | Mochizuki et al. | 399/49 |
| 2004/0131373 | A1 | 7/2004 | Saito et al. | 399/66 |
| 2005/0036798 | A1 | 2/2005 | Mochizuki | 399/44 |
| 2005/0063739 | A1* | 3/2005 | Kobayashi et al. | 399/299 |

FOREIGN PATENT DOCUMENTS

| | | |
|---|---|---|
| JP | 2000-315023 | 11/2000 |
| JP | 2002-139882 | 5/2002 |
| JP | 2002-148893 | 5/2002 |
| JP | 2002-148898 | 5/2002 |
| JP | 2003-140431 | 5/2003 |
| JP | 2003-215881 | 7/2003 |

* cited by examiner

SCATTERING EVALUATION

| BRIGHTNESS | 30 | 40 | 50 | 60 | 70 |
|---|---|---|---|---|---|
| | × | × | △ | ○ | ○ |

○ GOOD LEVEL

△ PERMISSIBLE LEVEL

× IMPERMISSIBLE LEVEL

IMAGE FORMING APPARATUS WHICH PRESENTS FAULTY IMAGE WHEN TONER IMAGE ON IMAGE BEARING MEMBER IS TRANSFERRED TO TRANSFERRING MEDIUM

BACKGROUND OF THE INVENTION

1. Field of the Invention

This invention relates to an image forming apparatus in which a toner image on an image bearing member is repetitively transferred to a transferring medium, wherein the lowering of the quality of image when the toner image is transferred to the transferring medium is prevented.

2. Related Background Art

When a toner image on an image bearing member is to be repetitively transferred to a transferring medium, as shown in FIG. 18 of the accompanying drawings, there is the problem that there occurs so-called "re-transferring" in which when a toner image transferred from an image bearing member 1*a* on the upstream side with respect to the direction of movement (arrow R51) of a transferring medium 51 to the transferring medium 51 is transferred to an image bearing member 1*b* on the downstream side when a toner image on the image bearing member 1*b* is transferred to the transferring medium 51. Due to the occurrence of the re-transferring, an image of desired density is not obtained and the quality of image is lowered.

Heretofore, in order to solve the problem of this re-transferring, as shown in FIG. 19 of the accompanying drawings, a transfer member 5 for transferring a toner image on an image bearing member 1 to a transferring, medium 51 has been provided upstream of an area N in which the image bearing member 1 and the transferring medium 51 contact with each other, with respect to the direction of movement (R51) of the transferring medium 51.

The cause of the occurrence of the re-transferring is considered to be that the charging polarity of the toner image on the transferring medium 51 is reversed by an electric current flowing through the area N in which the image bearing member 1 and the transferring medium 51 contact with each other. The more becomes the electric current flowing through the area N in which the image bearing member 1 and the transferring medium 51 contact with each other, the greater becomes the amount of toner of which the charging polarity is reversed, and the re-transferring becomes liable to occur.

If the transfer member 5 is provided upstream of the area N in which the image bearing member 1 and the transferring medium 51 contact with each other with respect to the direction of movement (R51) of the recording medium, discharge occurs at a gap A upstream of the area N in which the image bearing member 1 and the transferring medium 51 contact with each other. By this discharge, the potential difference between the surface of the image bearing member 1 and the surface of the transferring medium 51 becomes small. Thereupon, the electric current flowing through the area N in which the image bearing member and the transferring medium contact with each other during transferring becomes little, and the occurrence of the re-transferring is prevented.

However, if the transfer member 5 is provided upstream of the area N in which the image bearing member 1 and the transferring medium 51 contact with each other with respect to the direction of movement of the transferring medium 51, so-called "scattering" in which the toner scatters around the toner image transferred to the transferring medium 51 occurs. The quality of image is lowered by the occurrence of the scattering. The cause of this scattering is considered to be that due to the discharge at the gap A, the toner image on the image bearing member flies to the recording medium at the gap A.

Here, the re-transferring and the scattering cannot be prevented, and there has arisen the problem that the quality of image is lowered.

SUMMARY OF THE INVENTION

So, it is an object of the present invention to provide an image forming apparatus in which when a toner image on an image bearing member is to be repetitively transferred to a transferring medium, re-transferring and scattering can be prevented to thereby prevent the lowering of the quality of image.

It is another object of the present invention to provide an image forming apparatus having:

An image bearing member;

electrostatic image forming means for forming an electrostatic image on the image bearing member;

developing means having toners differing in brightness, and for developing the electrostatic image to thereby form a toner image;

a transferring medium contacting with the image bearing member and moved in a predetermined direction, and to which a plurality of toner images differing in brightness are transferred;

a transfer member for imparting charges to a rear surface opposite to a surface of the transferring medium to which the toner images are transferred, by a bias being applied thereto, and transferring the toner image on the image bearing member to the transferring medium; and bias applying means for applying the bias to the transfer member while transfer by the transfer member effected;

wherein the set condition of the transfer member differs in conformity with the brightness of the toner of the toner image the transfer member transfers.

DETAILED DESCRIPTION OF THE PREFERRED EMBODIMENTS

In the present invention, the set condition of a transfer member is made different in conformity with the brightness of the toner of a toner image the transfer member transfers to a transferring medium.

That is, it is to be understood that the position of the transfer member relative to an image bearing member in the direction of movement of the transferring medium is more upstream in a case the brightness of the toner of the toner image transferred is equal to or greater than a predetermined value than in a case the brightness is less than the predetermined value.

Here, the toner of which the brightness is equal to or greater than the predetermined value is less conspicuous in scattering, and does not cause the lowering of the quality of image.

So, the transfer member which transfers a toner image of which the brightness of the toner is equal to or greater than the predetermined value is provided at a position whereat discharge occurs at a gap upstream of an area in which the image bearing member and the transferring medium contact with each other. Thereby, re-transferring does not occur.

In this manner, the re-transferring and the scattering could be prevented to thereby prevent the lowering of the quality of image.

Some embodiments of the present invention will hereinafter be described in detail.

<First Embodiment>

Figure 1:
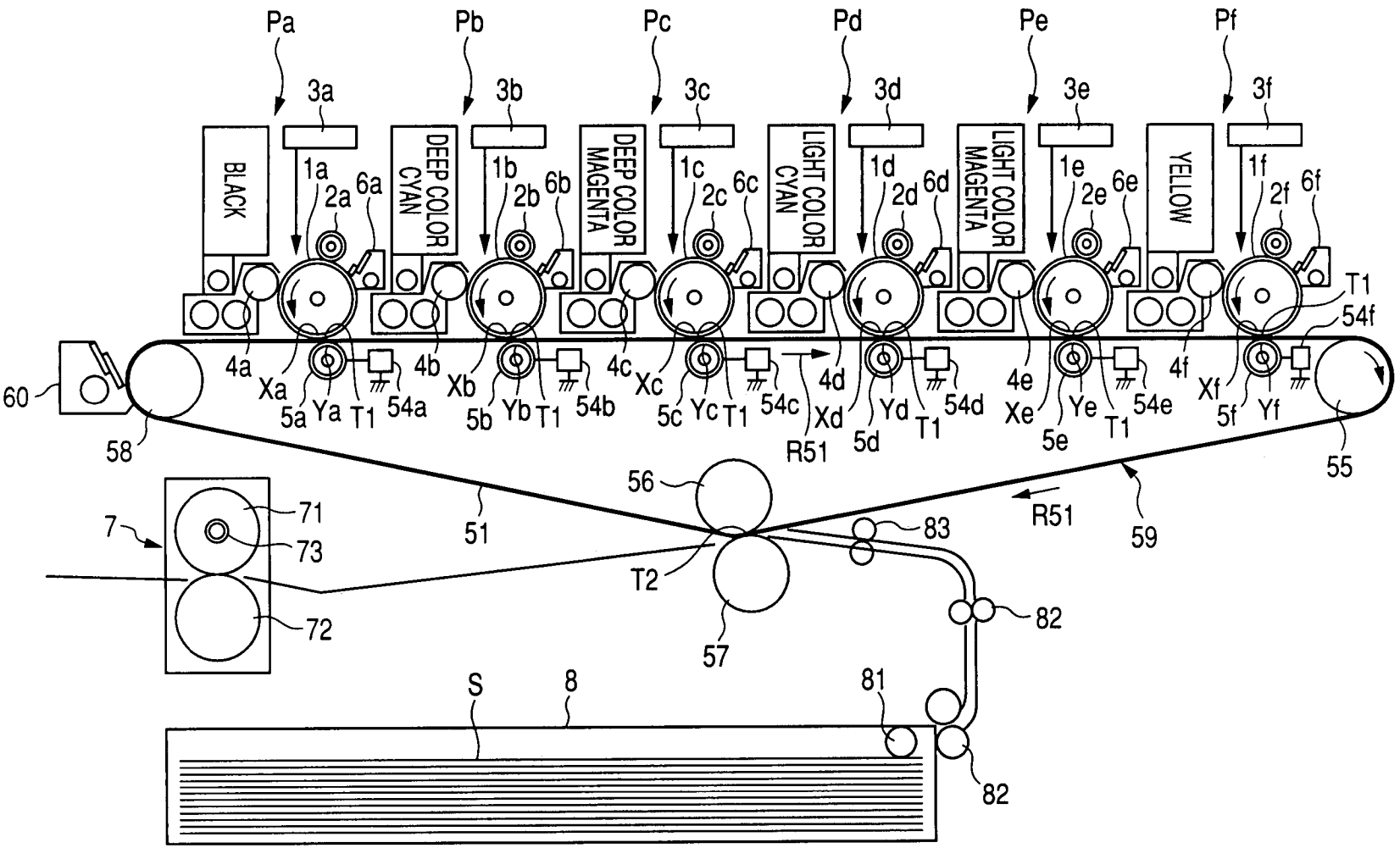
FIG. 1 schematically shows the construction of an image forming apparatus according to a first embodiment of the present invention.

FIG. 1 shows an image forming apparatus according to a first embodiment as an example of the image forming apparatus of the present invention. The image forming apparatus shown in FIG. 1 is an image forming apparatus of an electrophotographic type using an intermediate transfer belt (intermediate transfer member) 51 as a transferring medium. Also, it is provided with process units of six colors, i.e., a first process unit Pa, a second process unit Pb, a third process unit Pc, a fourth process unit Pd, a fifth process unit Pe and a sixth process unit Pf in the named order from an upstream side to a downstream side along the direction of rotation (the direction of movement: the direction of arrow R51) of the intermediate transfer belt 51.

In the present embodiments, the first to sixth process units Pa to Pf are process units forming toner images of black, deep color cyan (CH), deep color magenta (MH), light color cyan (CL), light color magenta (ML) and yellow (Y), respectively, in the named order. The respective process units Pa, Pb, Pc, Pd, Pe and Pf have drum-shaped electrophotographic photosensitive members (hereinafter referred to as the "photosensitive drums") 1*a*, 1*b*, 1*c*, 1*d*, 1*e* and 1*f* as image bearing members, and each of these photosensitive drums is rotatively driven at a predetermined process speed (peripheral speed) in the direction of arrow by driving means (not shown).

Charging rollers (charging means) 2*a*, 2*b*, 2*c*, 2*d*, 2*e*, 2*f*, exposing apparatuses (exposing means) 3*a*, 3*b*, 3*c*, 3*d*, 3*e*, 3*f*, developing devices (developing means) 4*a*, 4*b*, 4*c*, 4*d*, 4*e*, 4*f*, primary transfer rollers 5*a*, 5*b*, 5*c*, 5*d*, 5*e*, 5*f* as transfer members (primary transfer members), and cleaning apparatuses (cleaning means) 6*a*, 6*b*, 6*c*, 6*d*, 6*e*, 6*f* are successively disposed around the respective photosensitive drums 1*a*, 1*b*, 1*c*, 1*d*, 1*f* substantially in the named order from the upstream side along the direction of rotation thereof.

The process units Pa, Pb, Pc, Pd, Pe, Pf will now be described with reference to FIG. 2. These six process units Pa, Pb, Pc, Pd, Pe, Pf are of the same construction and therefore, will hereinafter be described with the suffixes a, b, c, d, e and f omitted.

Figure 2:
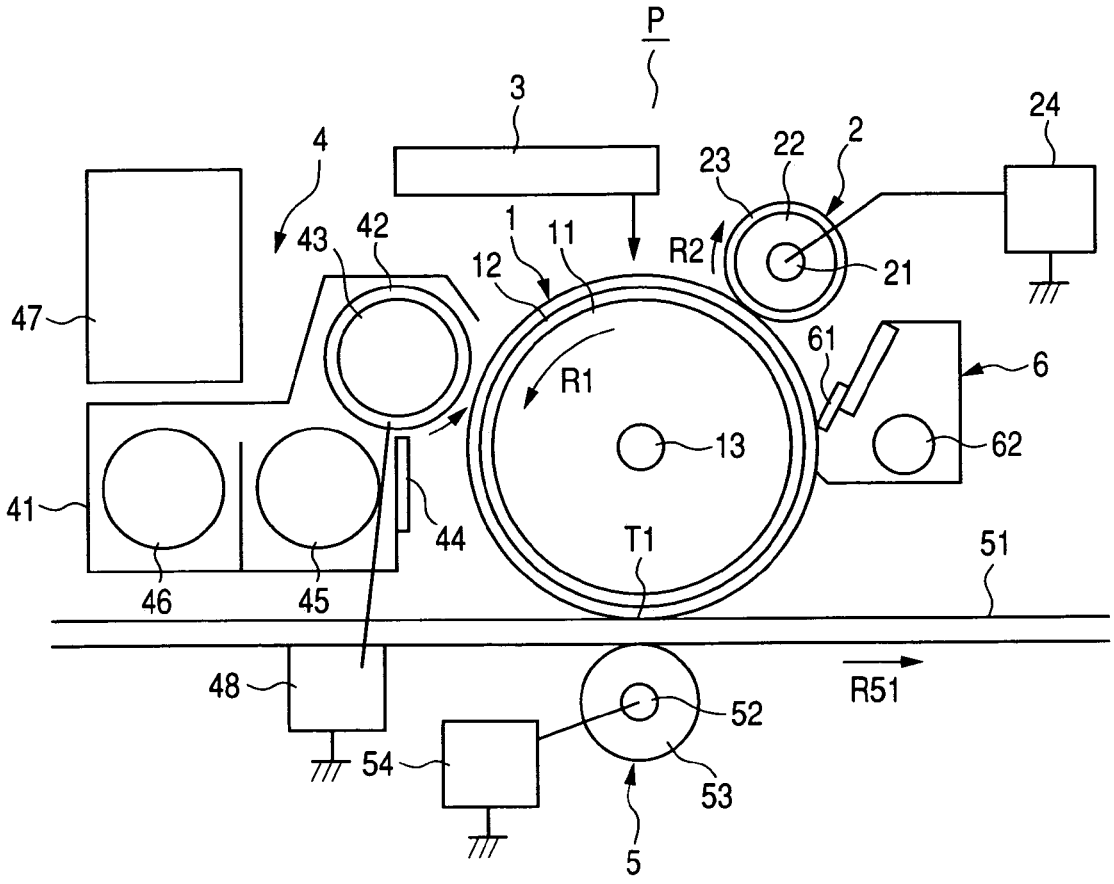
FIG. 2 schematically shows the construction of the process unit of the image forming apparatus according to the first embodiment.

As shown in FIG. 2, the process units p has the photosensitive drum 1 rotatably supported by an image forming apparatus main body (not shown). The photosensitive drum 1 is a cylindrical OPC photosensitive member having as a basic construction an electrically conductive base 11 of aluminum or the like and a photoconductive layer 12 formed on the outer periphery thereof. It has a spindle 13 at its center, and is adapted to be rotatively driven in the direction of arrow R1 about this spindle 13 at a predetermined process speed (peripheral speed) by driving means (not shown).

The charging roller 2 as charging means is disposed above the photosensitive drum 1. The charging roller 2 is disposed so as to contact with the surface of the photosensitive drum 1, and uniformly charges the surface of the photosensitive drum 1 to a predetermined polarity and potential, and is formed into a roller shape as a whole. The charging roller 2 comprises a centrally disposed electrically conductive mandrel 21, and a low-resistance electrically conducting layer 22 and a medium-resistance electrically conducting layer 23 formed on the outer periphery thereof, and has the opposite end portions of the mandrel 21 rotatably supported by bearing members (not shown) and is disposed in parallelism to the photosensitive drum 1. The bearing members at these opposite end portions are biased toward the photosensitive drum 1 by urging members (not shown, whereby the charging roller 2 is brought into pressure contact with the surface of the photosensitive drum 1 with a predetermined pressure force. The charging roller 2 is driven to rotate in the direction of arrow R2 by the rotation of the rotation of the photosensitive drum 1 in the direction of arrow R1. The charging roller 2 has a charging bias voltage applied thereto by a voltage source 24, whereby it is adapted to uniformly contact-charge the surface of the photosensitive drum 1.

The exposing apparatus 3 as exposing means is disposed downstream of the charging roller 2 with respect to the direction of rotation of the photosensitive drum 1. The exposing apparatus 3 scans and exposes the charged surface of the photosensitive drum 1 while turning on and off a laser beam, for example, on the basis of image information, and eliminates the charges of the exposed portion and forms an electrostatic latent image conforming to the image information.

The developing device 4 disposed downstream of the exposing apparatus 3 has a developing container 41 containing a two-component developer therein. A developing sleeve 42 is rotatably installed in the opening portion of the developing container 41 which faces the photosensitive drum 1. A magnet roller 43 for causing the developer to be carried on the developing sleeve 42 is fixedly disposed in this developing sleeve 42 against rotation relative to the rotation of the developing sleeve 42. A regulating blade 44 for regulating the developer carried on the developing sleeve 42 to thereby form the developer into a thin layer of developer is installed below the developing sleeve 42 of the developing container 41. Further, a developing chamber 45 and an agitating chamber 46 compacted from each other are provided in the developing container 41, and a supplying chamber 47 containing therein a toner to be supplied is provided above them. The developer formed into the thin layer of developer, when carried to a developing area opposed to the photosensitive drum 1, comes into ears by the magnetic force of a developing main pole located in the developing area of the magnet roller 43, and the magnetic brush of the developer is formed. This magnetic brush rubs against the surface of the photosensitive drum 1 and a developing bias voltage is applied to the developing sleeve 42 by a voltage source 48, whereby the toner adhering to a carrier constituting the ears of the magnetic brush adheres to and develops the exposed portion of the electrostatic latent image, and a toner image is formed on the photosensitive drum 1.

The primary transfer roller 5 is disposed below the photosensitive drum 1 downstream of the developing device 4. The primary transfer roller 5 is constituted by a mandrel 52 having a bias applied thereto by a voltage source 54, and an electrically conducting layer 53 formed into a cylindrical shape on the outer peripheral surface thereof. The primary transfer roller 5 has its opposite end portions biased toward the photosensitive drum 1 by an urging member (not shown) such as a spring, whereby the electrically conducting layer 53 of the primary transfer roller 5 is brought into pressure contact with the surface of the photosensitive drum 1 with a predetermined pressure force with the intermediate transfer belt 51 interposed therebetween, and a primary transferring portion (a primary transferring nip portion) T1 is formed between the photosensitive drum 1 and the intermediate transfer belt 51. The intermediate transfer belt 51 is nipped by the primary transferring portion T1, and a transferring bias voltage opposite in polarity to the polarity of the toner is applied thereto by the voltage source 54, whereby the toner image on the photosensitive drum 1 is transferred (primary-transferred) to the surface of the intermediate transfer belt 51.

The photosensitive drum 1 after the transfer of the toner image has any adhering substances such as any residual toner thereon removed by the cleaning apparatus 6. The cleaning apparatus 6 has a cleaner blade 61 and a carrying screw 62, and the cleaner blade 61 is made to abut against the photosensitive drum 1 at a predetermined angle and with predetermined pressure by pressurizing means (not shown), and collects the toner, etc. residual on the surface of the photosensitive drum 1. The thus collected residual toner, etc. are carried and discharged by the carrying screw 62.

In FIG. 1, an intermediate transfer unit 59 is disposed below the photosensitive drums 1*a* to 1*f*. The intermediate transfer unit 59 is constituted by the intermediate transfer belt 51, a drive roller 55, a driven roller 58 and a secondary transfer opposed roller 56 over which the intermediate transfer belt 5 is passed, the above-described primary transfer rollers 5*a* to 5*f*, a secondary transfer roller 57, a belt cleaner 60, etc.

The above-mentioned secondary transfer roller 57 nips the intermediate transfer belt 51 between it and the secondary transfer opposed roller 56, whereby a secondary transferring portion (a secondary transferring nip portion) T2 is formed between the secondary transfer roller 57 and the intermediate transfer belt 51.

In the image forming apparatus of the above-described construction, the toner images of the respective colors formed on the photosensitive drums 1*a*, 1*b*, 1*c*, 1*d*, 1*e* and 1*f* are successively transferred (primary-transferred) onto the intermediate transfer belt 51 in the respective primary transferring portions T1 by receiving a transferring bias from the primary transfer rollers 5*a*, 5*b*, 5*c*, 5*d*, 5*e* and 5*f* opposed to the respective photosensitive drums with the intermediate transfer belt 51 interposed therebetween, and are carried to the secondary transferring portion T2 with the rotation of the intermediate transfer belt 51 in the direction of arrow 51. On the other hand, a recording material S contained in a sheet supplying cassette 8 is fed by a sheet feeding roller 81 by this time, is conveyed by conveying rollers 82, and is further supplied to the secondary transferring portion T2 by registration rollers 83 at predetermined timing, that is, in such a manner to be timed with the toner images on the intermediate transfer belt 51. The recording material S has the toner images collectively transferred (secondary-transferred) to its surface in the secondary transferring portion T2 by a secondary transferring bias applied to between the secondary transfer roller 57 and the secondary transfer opposed roller 56. The toner (secondary residual toner), etc. not transferred to the recording material S at this time, but residual on the intermediate transfer belt 51 are removed and collected by a belt cleaner 60.

A fixing apparatus 7 has a rotatably disposed fixing roller 71 and a pressure roller 72 rotated while being in pressure contact with the fixing roller 71. A heater 73 such as a halogen lamp is disposed in the interior of the fixing roller 71, and a voltage or the like to the heater 73 is controlled to thereby effect the temperature control of the surface of the fixing roller 71. When in this state, the recording material S is conveyed, the fixing roller 71 and the pressure roller 72 are rotated at a predetermined speed, and the recording material S is pressurized and heated from its opposite surfaces with substantially constant pressure and at a constant temperature when it passes between the fixing roller 71 and the pressure roller 72, whereby the unfixed toner images on the surface of the recording material S are fused and fixed, and a full-color image is formed on the recording material S.

The intermediate transfer belt 51 is formed of dielectric resin such as PC, PET or PVDF. In the present embodiment, PI resin of which the volume resistivity is $10^{8.5}\Omega\cdot$cm (use was made of a probe conforming to JIS-K6911 Law, applied voltage 100V, application time 60 sec., 23° C. 50% RH), and the thickness is t=100 μm was adapted, but other material having other volume resistivity and thickness may be adopted.

Also, the primary transfer roller 5 has a mandrel 52 having a diameter of 8 mm, and an electrically conductive urethane sponge layer having a thickness of 4 mm as an electrically conducting layer 53 surrounding the outer periphery thereof, and the resistance value thereof was found from the relation of an electric current measured with the primary transfer roller 5 rotated at a peripheral speed of 50 mm/sec. relative to the earth under a load of 500 g, and a voltage of 500V applied to the mandrel, and the value was $10^5\Omega$ (23° C. 50% RH).

Subsequently, description will be made of the setting of the transfer member which is a characteristic portion of the present invention.

The inventor has ascertained that the standard as to whether the "scattering" phenomenon occurring in the primary transferring portion when visually judged is permissible or not is correlated to the brightness of the image.

Figures 3, 4:
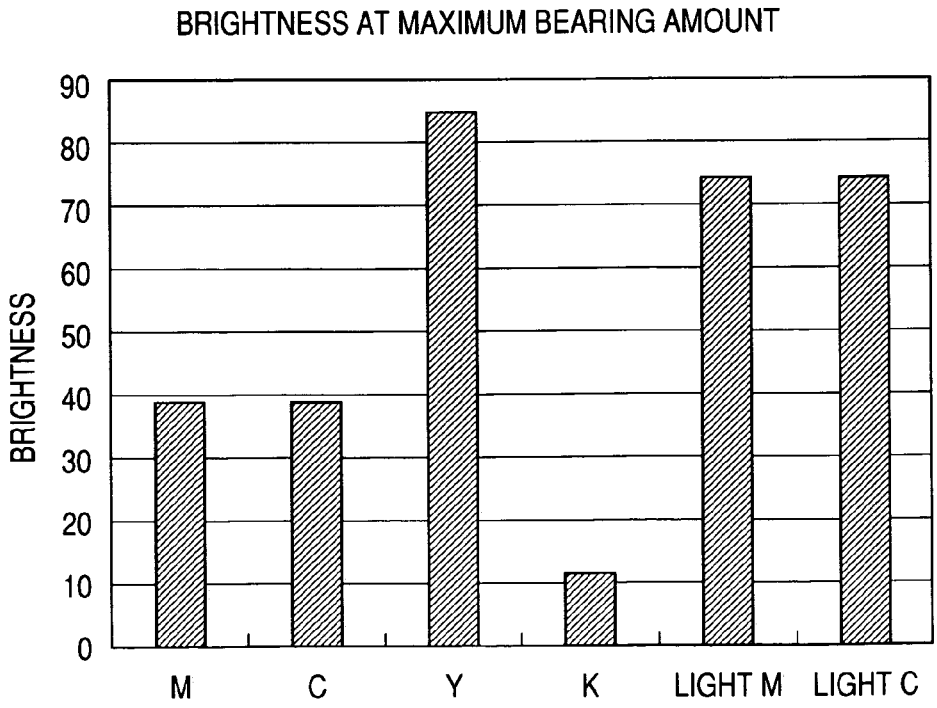
FIG. 3 shows the relation between the brightness of a toner and the evaluation of scattering in the first embodiment.
FIG. 4 is a graph showing the brightness of each toner used in the first embodiment at a maximum bearing amount.

FIG. 3 shows the relation between the degree of permissibility of a "scattering" image by visual judgment and brightness. In the present evaluation, a line having a length of 50 mm and a width of 0.169 mm (4 dots at 600 dpi) was purposely formed as an image in a state wherein "scattering" was present, and a sample to which brightness was allotted by changing such a condition as the amount of pigment in the toner was prepared, and was visually judged. In case of the preparation of the "scattering" image, use was made of the aforedescribed image forming apparatus in which the primary transfer roller 5 is disposed at a location 2 mm upstream of the location beneath the photosensitive drum 1 with respect to the direction of rotation (the direction of arrow R51) of the intermediate transfer belt 51 so that the electric field of the transferring bias may extend to upstream of the nip portion in the primary transferring portion T1 so as to dare to cause "scattering".

According to the result of the evaluation shown in FIG. 3, there was obtained the result that regarding lines over brightness 50, scattering occurring thereto was permissibly, but regarding lines below brightness 50, scattering was impermissible.

From the above-described result, in the image forming apparatus of the present invention, the set condition of the transfer member was made different in conformity with the brightness of the toner image, whereby re-transferring and scattering could be suppressed at a time to thereby prevent the lowering of the quality of image.

FIG. 4 shows the brightness of each of black (K), deep color cyan (C), deep color magenta (M), light color cyan (light C), light color magenta (light M) and yellow at a maximum bearing amount in a single color. The maximum bearing amount in a single color in the image forming apparatus of the present embodiment is 0.5 mg/cm$^2$ on the recording material S.

The measurement of the brightness was carried out by the use of the following method. As the recording material S, use was made of CLC paper (80 g/cm$^2$) (Canon Sales, Inc.) On this recording paper, a square toner image having a toner mass of 0.5 mg/cm$^2$ per unit area and a size of 30 mm×30 mm is formed. The fixing roller 71 was set at 190° C., and the recording material S was passed through the fixing apparatus at a speed of 130 mm/sec. to thereby fix the toner image on the recording material S. Here, the speed of the recording material and the temperature of the fixing roller are not restricted to the above-mentioned conditions, but it is to be understood that use is made of conditions determined by the image forming apparatus when CLC paper (80 g/cm$^2$) is used as the recording material S.

The toner image fixed on the recording material S is measured with D50 light source and at the incidence angle 0 degree of light and a reflection angle 45 degrees by the use of "Gretagmacbeth Color Spectrolino" as a measuring machine.

According to FIG. 4, it will be seen that the brightness of black, deep color cyan and deep color magenta is lower than 50, while on the other hand, the brightness of light color cyan, light color magenta and yellow is higher than 50.

Accordingly, in the image forming apparatus of the present embodiment, regarding black, deep color cyan and deep color magenta of which the brightness is lower than 50, the primary transfer rollers 5*a*, 5*b* and 5*c* for transferring these colors are installed downstream. In the present embodiment, the primary transfer rollers 5*a*, 5*b* and 5*c* are disposed at a location 2 mm downstream of the locations beneath the photosensitive drums 1*a*, 1*b* and 1*c* with respect to the direction of rotation of the intermediate transfer belt 51.

These black, deep color cyan and deep color magenta process units Pa, Pb and Pc themselves are disposed upstream (at the left in FIG. 1) of the other light color cyan, light color magenta and yellow process units Pd, Pe and Pf with respect to the direction of rotation of the intermediate transfer belt 51.

On the other hand, regarding light color cyan, light color magenta and yellow of which the brightness is higher than 50, the primary transfer rollers 5 for transferring these colors are installed relatively upstream. Thereby, setting is done for expediting the discharge upstream of the respective primary transferring portions T1, and suppressing "re-transferring". In the present embodiment, the primary transfer roller 5 is disposed at a location beneath the photosensitive drum 1. These light color cyan, light color magenta and yellow process units Pd, Pe and Pf themselves are disposed downstream (at the right in FIG. 1) of the other black, deep color cyan and deep color magenta process units Pa, Pb and Pc with respect to the direction of rotation of the intermediate transfer belt 51. Images formed by the present process units suffer from the occurrence of the "scattering" phenomenon during the transfer, but from the aforedescribed relation between the brightness and the degree of permissibility of scattering, it never happens that regarding these colors, "scattering" visually poses a problem.

As described above, according to the present invention, the set condition of the transfer member, in the present embodiment, the position of the primary transfer roller 5, is changed in conformity with the brightness of the toner. That is, the position of the primary transfer roller 5 relative to the photosensitive drum 1 in the direction of movement of the intermediate transfer belt 51 is more upstream in the case of yellow, light color magenta and light color cyan of which the brightness of the toner is equal to or greater than 50 than in the case of black, deep color cyan and deep color magenta of which the brightness of the toner is less than 50.

Thereby, it has become possible to prevent re-transferring and scattering, and the lowering of the quality of image could be prevented.

The specific position of the primary transfer roller 5 shown in the present embodiment is not restricted to what has been described above. That is, the optimum position is varied by the outer diameter, hardness and resistance value of the transfer roller, the transferring bias, the resistance of the intermediate transfer belt (intermediate transfer member), etc. and therefore, can be suitably set in conformity therewith.

Also, in the above-described image forming apparatus, the toners of six colors are used, but even in an image forming apparatus using toners of four colors, i.e., black (K), deep color cyan (CH), deep color magenta (MH) and yellow, a similar effect can be obtained by changing the position of the transfer member in conformity with the brightness of the toner of a toner image to be transferred.

Figure 5:
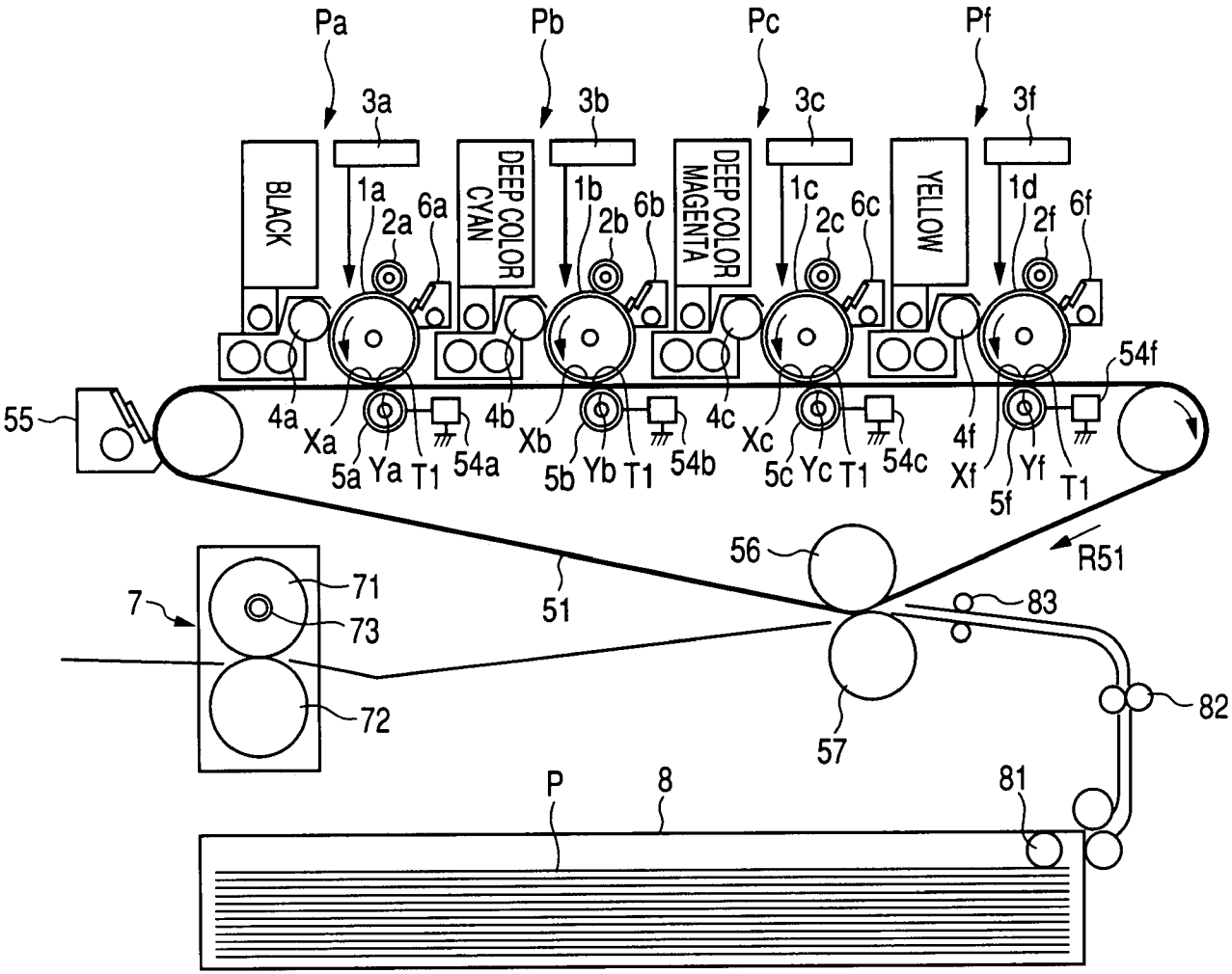
FIG. 5 schematically shows the construction of an image forming apparatus having four developing devices in the first embodiment.

FIG. 5 shows an image forming apparatus using four colors, i.e., black (K), deep color cyan (CH), deep color magenta (MH) and yellow. The image forming apparatus of FIG. 5 effects image forming by a method similar to that of the image forming apparatus shown in FIG. 1 with the exception that the number of developing devices is four, and the frequency with which the toner images on the photosensitive drums 1 are transferred to the intermediate transfer belt 51 decreases. In the image forming apparatus of FIG. 5, members similar in construction and action to those in FIG. 1 are given the same reference characters.

<Second Embodiment>

Figure 6:
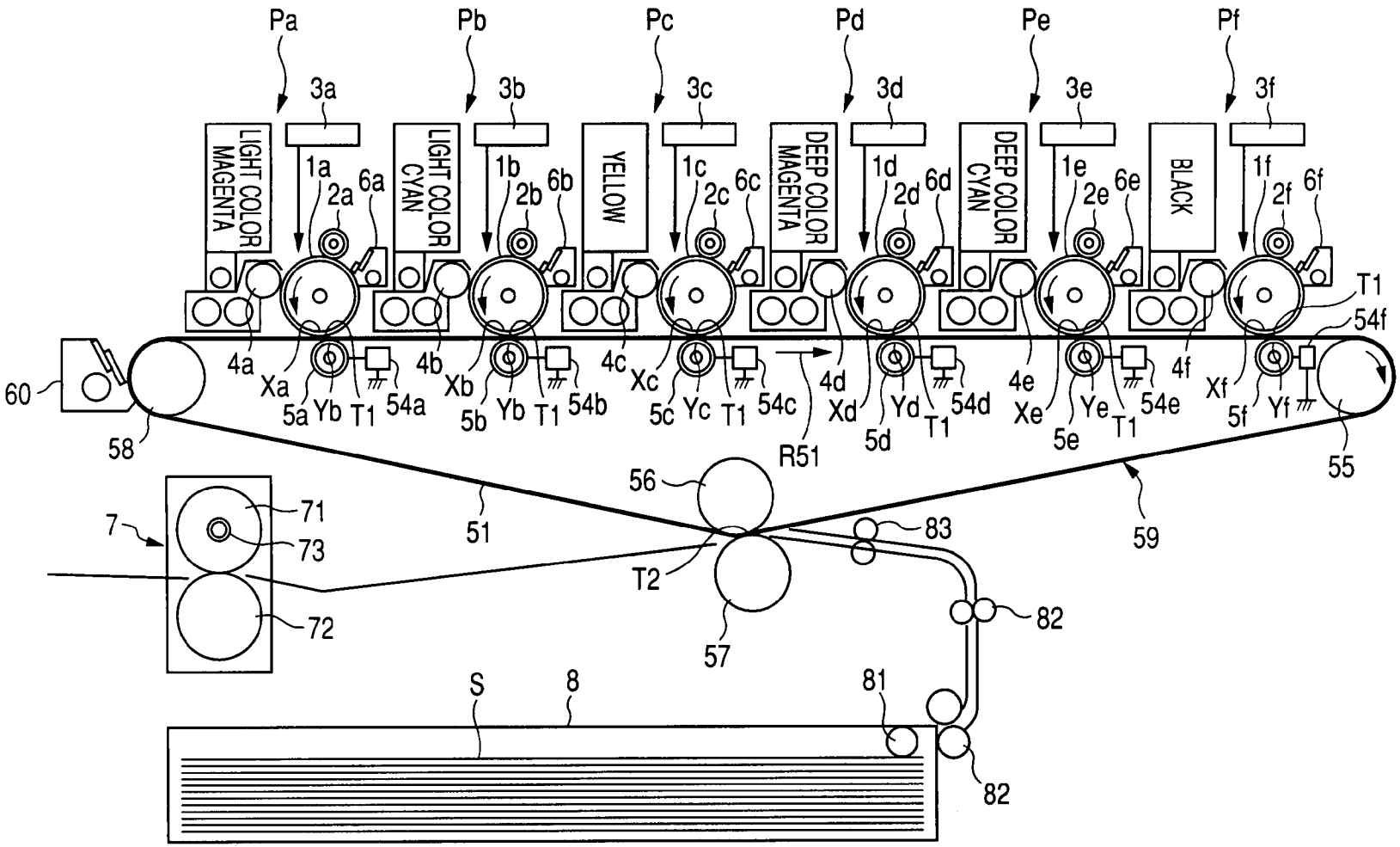
FIG. 6 schematically shows the construction of an image forming apparatus according to a second embodiment of the present invention.

An image forming apparatus according to this embodiment, as shown in FIG. 6, is similar in construction to the image forming apparatus shown in the above-described first embodiment (see FIG. 1) with the exception that the order of arrangement of the process units along the direction of rotation of the intermediate transfer belt 51 differs. Accordingly, the details of the construction and operation of this image forming apparatus need not be described.

The present embodiment has such an arrangement of process units as can make the time from after an operation has been started until printing is completed shortest when image forming is effected by the use of four colors, i.e., yellow, deep color magenta, deep color cyan and black used when forming a popular four-color full-color image, and when image forming is effected by the use of black only.

In the present embodiment, as shown in FIG. 6, the first to sixth process units Pa to Pf disposed in succession from the upstream side along the direction of rotation (the direction of arrow R51) of the intermediate transfer belt 51 are arranged in the order of light color magenta, light color cyan, yellow, deep color magenta, deep color cyan and black process units. By adopting such as arrangement, the intermediate transfer belt 51 can form images by the shortest movement distance when image forming is effected by the use of only four colors, i.e., yellow, deep color magenta, deep color cyan and black.

In the present embodiment, regarding light color magenta, deep color magenta, deep color cyan and black, the primary transfer rollers 5 (5*a* to 5*f*) are located 2 mm downstream of the locations beneath the photosensitive drums 1 with respect to the direction of rotation of the intermediate transfer belt 51. Light color magenta is high in brightness as described in the first embodiment and therefore, it is unnecessary to avoid the "scattering" phenomenon, but it is the most upstream process unit and therefore does not suffer from the occurrence of "re-transferring", thus adopting a construction avoiding "scattering".

On the other hand, regarding light color cyan and yellow, in order to avoid "re-transferring", the primary transfer rollers 5, i.e., the primary transfer rollers 5*b* and 5*c* are located beneath the photosensitive drums 1, and in the primary transferring portion T1 for light color cyan, the re-transferring of light color magenta of the intermediate transfer belt 51 can be avoided, and in the primary transferring portion T1 for yellow, the re-transferring of light color magenta and light color cyan can be avoided.

Thus, according to the second embodiment of the present invention, when in the image forming apparatus using deep color and light color toners, image forming was to be effected by the use of deep color toners only, the shortest printing time could be achieved and at the same time, re-transferring and scattering could be suppressed at a time to thereby suppress the lowering of the quality of image.

Also, in the above-described image forming apparatus, toners of six colors are used, but even in an image forming apparatus using toners of four colors, i.e., black (K), deep color cyan (CH), deep color magenta (MH) and yellow, a similar effect can be obtained by changing the position of the transfer member in conformity with the brightness of the toner of the toner image to be transferred.

Figure 7:
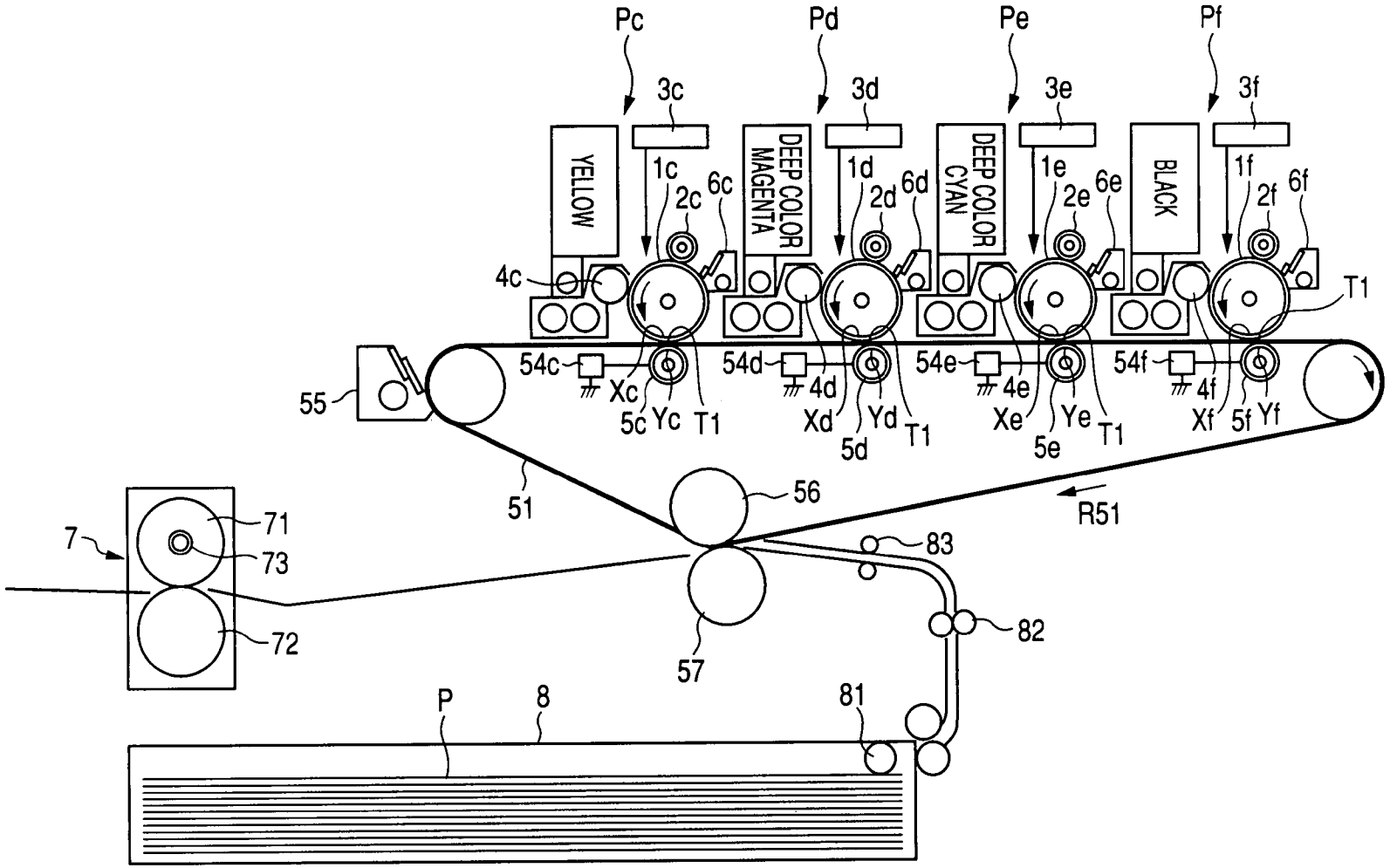
FIG. 7 schematically shows the construction of an image forming apparatus having four developing devices in the second embodiment.

FIG. 7 shows the image forming apparatus using the toners of four colors, i.e., black (K), deep color cyan (CH), deep color magenta (MH) and yellow. The image forming apparatus of FIG. 7 effects image forming by a method similar to that of the image forming apparatus shown in FIG. 6 with the exception that the number of developing devices is four, and the frequency with which the toner images on the photosensitive drums 1 are transferred to the intermediate transfer belt 51 decreases. In the image forming apparatus of FIG. 7, members similar in construction and action to those in FIG. 6 are given the same reference characters.

<Third Embodiment>

Figure 8:
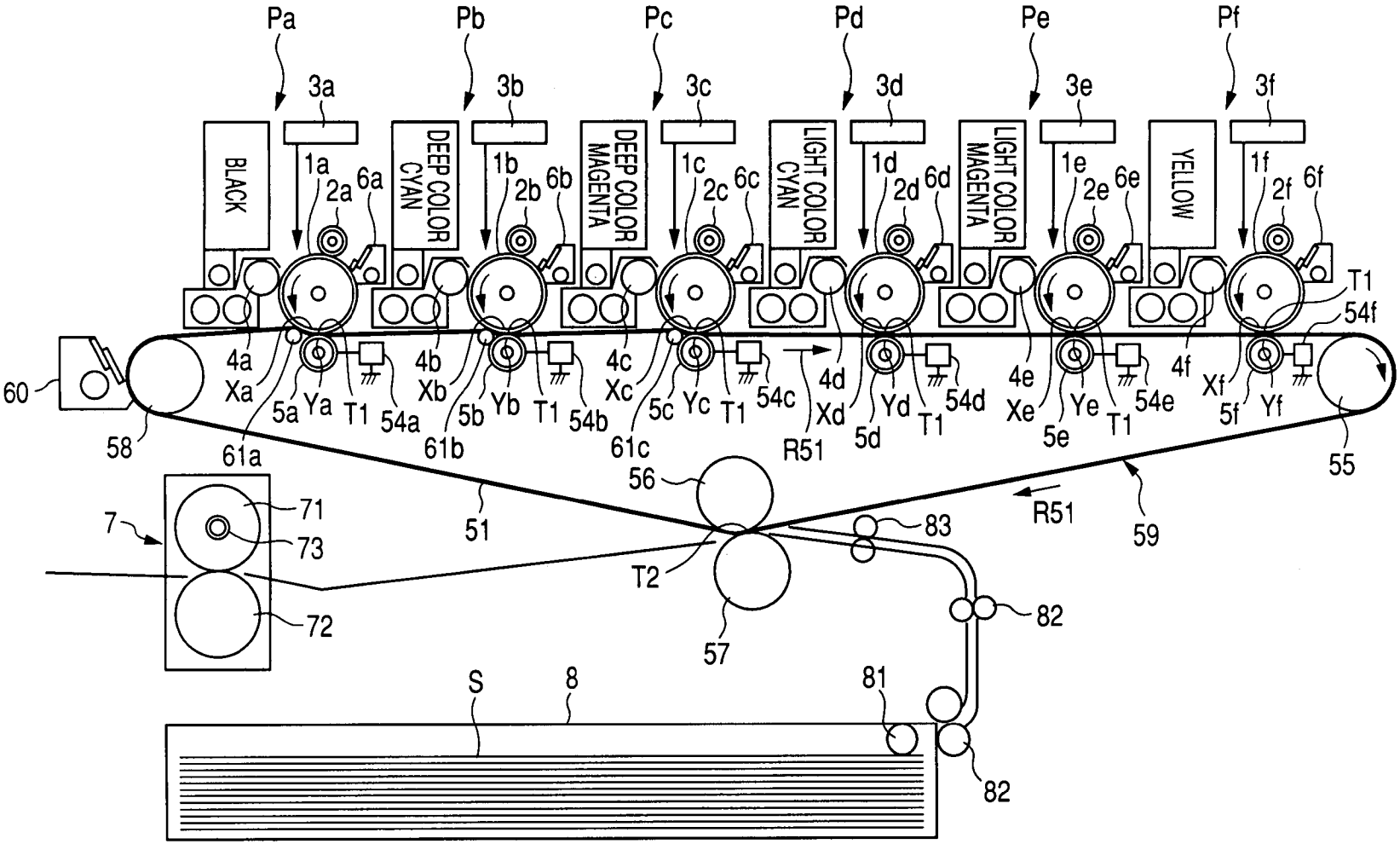
FIG. 8 schematically shows the construction of an image forming apparatus according to a third embodiment of the present invention.

An image forming apparatus according to this embodiment differs from the image forming apparatus of the aforedescribed first embodiment shown in FIG. 1 in that as shown in FIG. 8, push-up members 61*a*, 61*k* and 61*c* are provided upstream of the primary transferring portions T1 of the first, second and third process units Pa, Pb and Pc. That is, as the condition of the transfer member, the positions of the primary transfer rollers 5 are not changed, but as described above, the push-up members 61*a*, 61*b* and 61*c* are provided.

The image forming apparatus shown in FIG. 8, as in the first embodiment, has six process units (first to sixth process units Pa to Pf) in succession from the upstream side along the direction of rotation of the intermediate transfer belt 51. These first to sixth process units Pa to Pf are process units of black, deep color cyan, deep color magenta, light color cyan, light color magenta and yellow in the named order. The process units Pa, Pb and Pc of black, deep color cyan and deep color magenta of which the brightness is low are provided with push-up rollers 61*a*, 61*b* and 61*c*, respectively, upstream of the primary transfer rollers 5*a*, 5*b* and 5*c* as the transfer members. These push-up rollers 61*a*, 61*b* and 61*c* are for bringing the photosensitive drums 1*a*, 1*b* and 1*c* into close contact with the intermediate transfer belt 51 before the intermediate transfer belt 51 receives the influence of electric fields from the primary transfer rollers 5*a*, 5*b* and 5*c*. Regarding light color cyan, light color magenta and yellow of which the brightness is high, the primary transfer rollers 5*d*, 5*e* and 5*f*, as in the first embodiment, are disposed at locations beneath the photosensitive drums 1. As a result, the discharge upstream of the primary transferring portions T1 is expedited and "re-transferring" is suppressed.

As described above, in the present invention, the set condition of the transfer member, in the present embodiment, the shape of the nip of the primary transfer roller 5 near the primary transferring portion T1, is changed in conformity with the brightness of the toner. More particularly, the central position Y of an area in which the primary transfer roller 5 and the intermediate transfer belt 51 contact with each other, relative to the central position X of an area in which the photosensitive drum 1 and the intermediate transfer belt 51 contact with each other in the direction of movement of the intermediate transfer belt 51 is more upstream in the case of yellow, light color magenta and light color cyan of which the brightness of the toner is equal to or greater than 50 than in the case of black, deep color cyan and deep color magenta of which the brightness of the toner is less than 50.

Thereby, it has become possible to prevent re-transferring and scattering at a time, and the lowering of the quality of image could be prevented.

In the above-described image forming apparatus, toners of six colors are used, but even in an image forming apparatus using toners of four colors, i.e., black (K), deep color cyan (CH), deep color magenta (MH) and yellow, a similar effect can be obtained by changing the position of the transfer member in conformity with the brightness of the toner of the toner image to be transferred.

Figure 9:
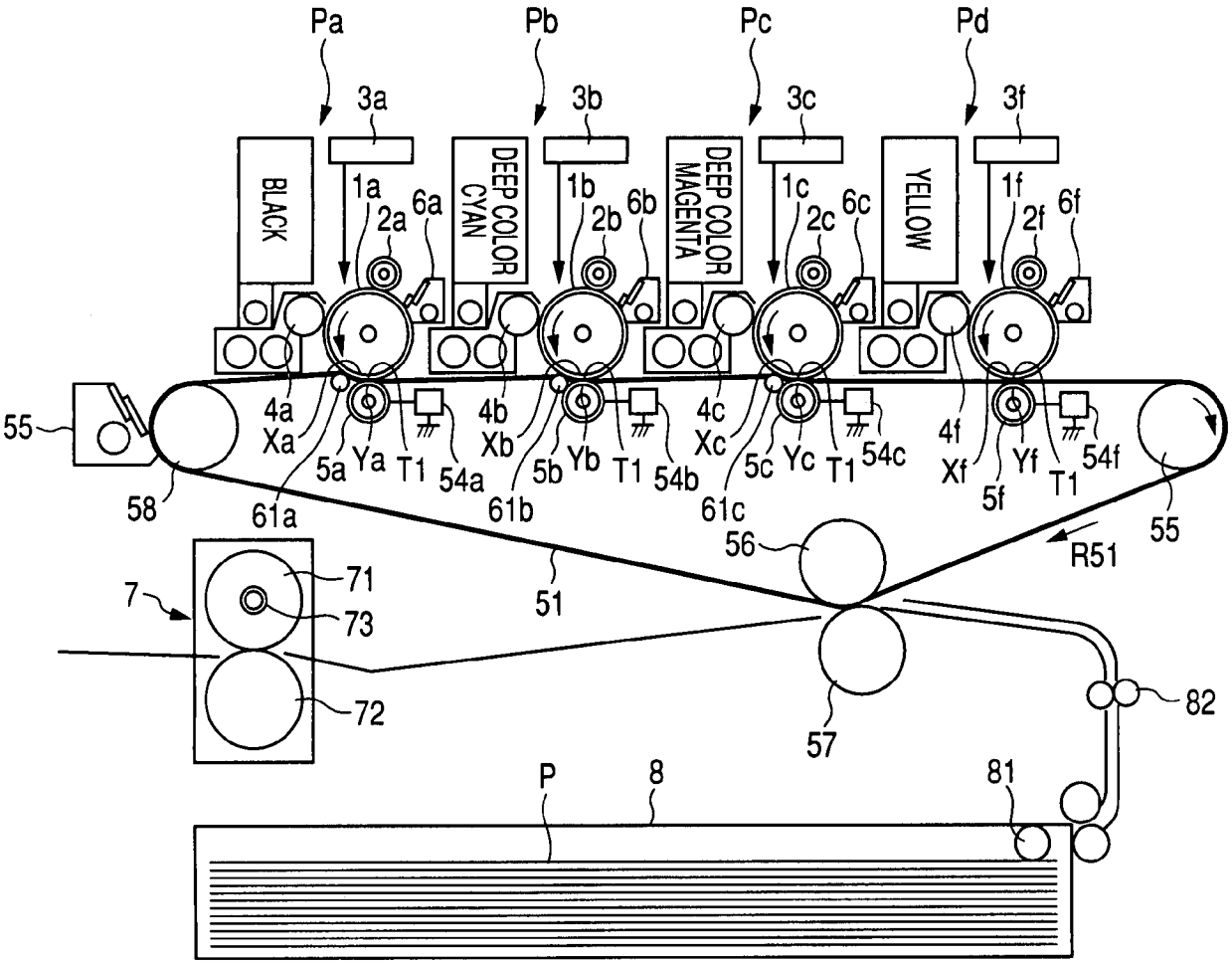
FIG. 9 schematically shows the construction of an image forming apparatus having four developing devices in the third embodiment.

FIG. 9 shows the image forming apparatus using four colors, i.e., black (K), deep color cyan (CH), deep color magenta (MH) and yellow. The image forming apparatus of FIG. 9 effects image forming by a method similar to that of the image forming apparatus shown in FIG. 8 with the exception that the number of developing devices is four, and the frequency with which the toner images on the photosensitive drums 5 are transferred to the intermediate transfer belt 51 decreases.

Also, in the image forming apparatus of FIG. 9, members similar in construction and action to those in FIG. 8 are given the same reference characters.

<Fourth Embodiment>

An image forming apparatus according to this embodiment is such that in a case where a toner image differing in brightness has been formed on a photosensitive drum 1, when the toner image is to be transferred from the photosensitive drum 1 to the intermediate transfer belt (intermediate transfer member) 51, the set condition of the transfer member is changed in conformity with the brightness of the toner thereof.

Figure 10:
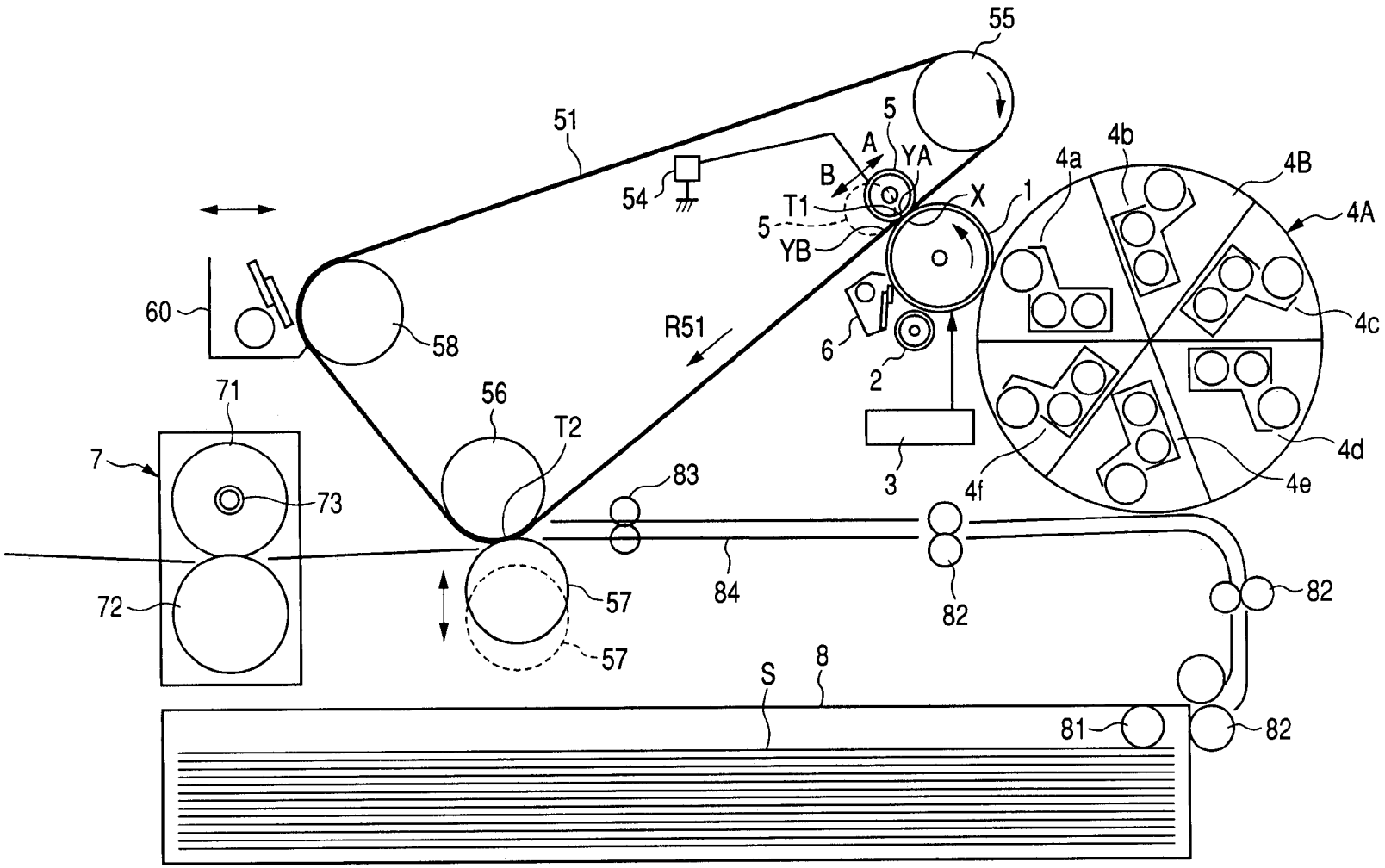
FIG. 10 schematically shows the construction of an image forming apparatus according to a fourth embodiment of the present invention.

FIG. 10 shows the epitome of an image forming apparatus according to the present embodiment. The image forming apparatus shown in FIG. 10 is a full color image forming apparatus of an electrophotographic type having a photosensitive drum 1 and an intermediate transfer belt (intermediate transfer member) 51.

The image forming apparatus shown in FIG. 10 is provided with a drum shaped electrophotographic photosensitive member (photosensitive drum) 1 as an image bearing member. A charging roller (charging means) 2, an exposing apparatus (exposing means) 3, a developing unit (developing means) 4A, a primary transfer roller 5 as a transfer member (primary transfer member), a cleaning apparatus (cleaning means) 6, etc. are disposed around the photosensitive drum 1 along the direction of rotation (the direction of arrow) thereof. An intermediate transfer belt 51 as an intermediate transfer member is disposed adjacent to the photosensitive drum 1. The intermediate transfer belt 51 is passed over a drive roller 55, a driven roller 58 and a secondary transfer opposed roller 56. The constructions and operation of the photosensitive drum 1, the primary charging device 2, the exposing apparatus 3, the cleaning apparatus 6, etc. are substantially similar to those in the above-described first to third embodiments and therefore need not be described in detail.

The developing unit 4A has a rotatable rotary 4B, and six developing devices, i.e., first to sixth developing devices 4*a* to 4*f*, carried thereon. The first to sixth developing devices 4*a* to 4*f*, in the named order, are developing devices for forming toner images of six colors, i.e., black, deep color cyan, deep color magenta, light color cyan, light color magenta and yellow. Of these six developing devices 4*a* to 4*f*, a developing device used for developing is adapted to be disposed at a developing position opposed to the surface of the photosensitive drum 1 by the rotation of the rotary 4B.

First, a toner image of the first color is formed on the photosensitive drum 1 by the developing device 4*a*, and is primary-transferred onto the intermediate transfer belt 51. The photosensitive drum 1 after the primary transfer has any adhering substances such as residual toner thereon removed by the cleaning apparatus 6. Subsequently, the rotary 4B is rotated, whereby the developing device 4*b* for developing with a toner of the second color arrives at the developing position opposed to the photosensitive drum 1, whereupon a toner image of the second color is likewise formed on the photosensitive drum 1. On the other hand, as regards the intermediate transfer belt 51, after the image of the first color has been transferred thereto in a primary transferring portion T1, the same portion thereof again arrives at the primary transferring portion T1 by rotation, and a toner image of the second color is primary-transferred from the photosensitive drum 1 to the intermediate transfer belt. In the meantime, a secondary transfer roller 57 and a belt cleaner 60 are spaced apart from the intermediate transfer belt 51, and do not disturb the toner images on the intermediate transfer belt 51.

Thereafter, toner images of the third to sixth colors are successively formed on the photosensitive drum 1, and are successively primary-transferred onto the intermediate transfer belt 51, whereupon in a secondary transferring portion T2, the secondary transfer roller 57 comes into contact with the intermediate transfer belt 51, and on the other hand, a recording material S fed from a sheet supplying cassette 8 by a sheet feeding roller 81 is conveyed to registration rollers 83 along a conveying guide 84 by conveying rollers 82. The recording material S is supplied to the secondary transferring portion T2 between the secondary transfer roller 57 and the intermediate transfer belt 51 in such a manner as to be timed with the toner images on the intermediate transfer belt 51 by the registration rollers 83. When the recording material S passes through the secondary transferring portion T2, the toner images on the intermediate transfer belt 51 are collectively secondary-transferred to the recording material S by a secondary transferring bias applied to between the secondary transfer roller 57 and the secondary transfer opposed roller 56. Any residual toners, etc. on the intermediate transfer belt 51 are removed and collected by the belt cleaner 60.

Thereafter, the recording material S, when it passes between the fixing roller 71 and the pressure roller 72 in the fixing apparatus 7, is pressurized and heated from its front and rear surfaces, whereby the unfixed toner images on the surface of the recording material S are fused and fixed, and a full-color image is formed on the recording material S.

Detailed description will now be made of the operation of the primary transfer roller (transfer member) 5 during primary transfer which is a characteristic portion of the present embodiment.

In the image forming apparatus of the present embodiment, the primary transfer roller 5 is movable substantially along the direction of movement of the intermediate transfer belt 51. The primary transfer roller 5 is designed to be movable between a position YA substantially corresponding to the center of the portion of contact between the photosensitive drum 1 and the intermediate transfer belt 51 and a position YB which is downstream of the position YA with respect to the direction of rotation (the direction of arrow R51) of the intermediate transfer belt 51. In a case where a toner low in brightness is formed on the photosensitive drum 1 and this toner image is to be transferred, the primary transfer roller 5 is disposed at the position YB. On the other hand, in a case where a toner high in brightness is to be transferred, the primary transfer roller 5 is disposed at the position YA.

As described above, even in an image forming apparatus of a construction in which toners differing in brightness are successively formed on one and the same photosensitive drum 1 and primary-transferred onto the intermediate transfer belt 51, the position of the primary transfer roller 5 is suitably moved in conformity with the brightness of the primary-transferred toner image, whereby it becomes possible to suppress the occurrence of re-transferring and scattering at a time to thereby suppress the lowering of the quality of image.

While in the present embodiment, description has been made in detail of the construction in which the position of the primary transfer roller 5 is made movable, such a push-up member as described in the third embodiment with reference to FIG. 8 may be disposed upstream of the primary transferring portion T1.

Further, while in the present embodiment, description has been made of the image forming apparatus provided with only one photosensitive drum 1, the present invention can also be applied to an image forming apparatus which is provided with a plurality of photosensitive drums and in which toner images differing in brightness are formed on at least one of the photosensitive drums and are transferred.

In the above-described image forming apparatus, toners of six colors are used, but even in an image forming apparatus using toners of four colors, i.e., black (K), deep color cyan (CH), deep color magenta (MH) and yellow, a similar effect can be obtained by changing the position of the transfer member in conformity with the brightness of the toner of the toner image to be transferred.

Figure 11:
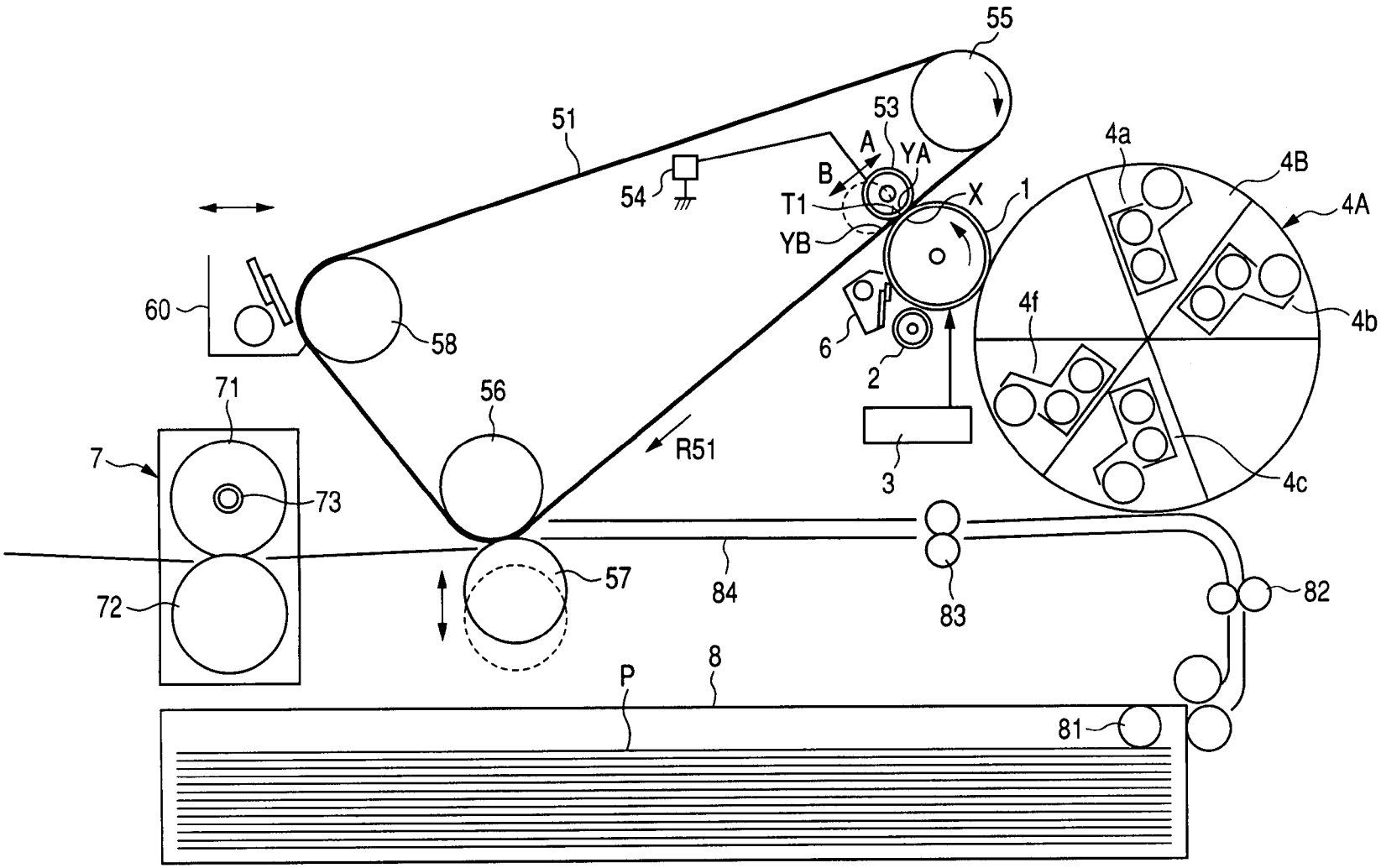
FIG. 11 schematically shows the construction of an image forming apparatus having four developing devices in the fourth embodiment.

FIG. 11 shows an image forming apparatus using toners of four colors, i.e., black (K), deep color cyan (CH), deep color magenta (MH) and yellow. The image forming apparatus of FIG. 11 effects image forming by a method similar to that of the image forming apparatus shown in FIG. 10 with the exception that the number of developing devices 4 is four, and the frequency with which the toner images on the photosensitive drum 1 are transferred to the intermediate transfer belt 51 decreases.

Also, in the image forming apparatus of FIG. 11, members similar in construction and action to those in FIG. 10 are given the same reference characters.

Further, such a push-up member 61 as described in the third embodiment with reference to FIG. 9 may be disposed.

<Fifth Embodiment>

Figure 12:
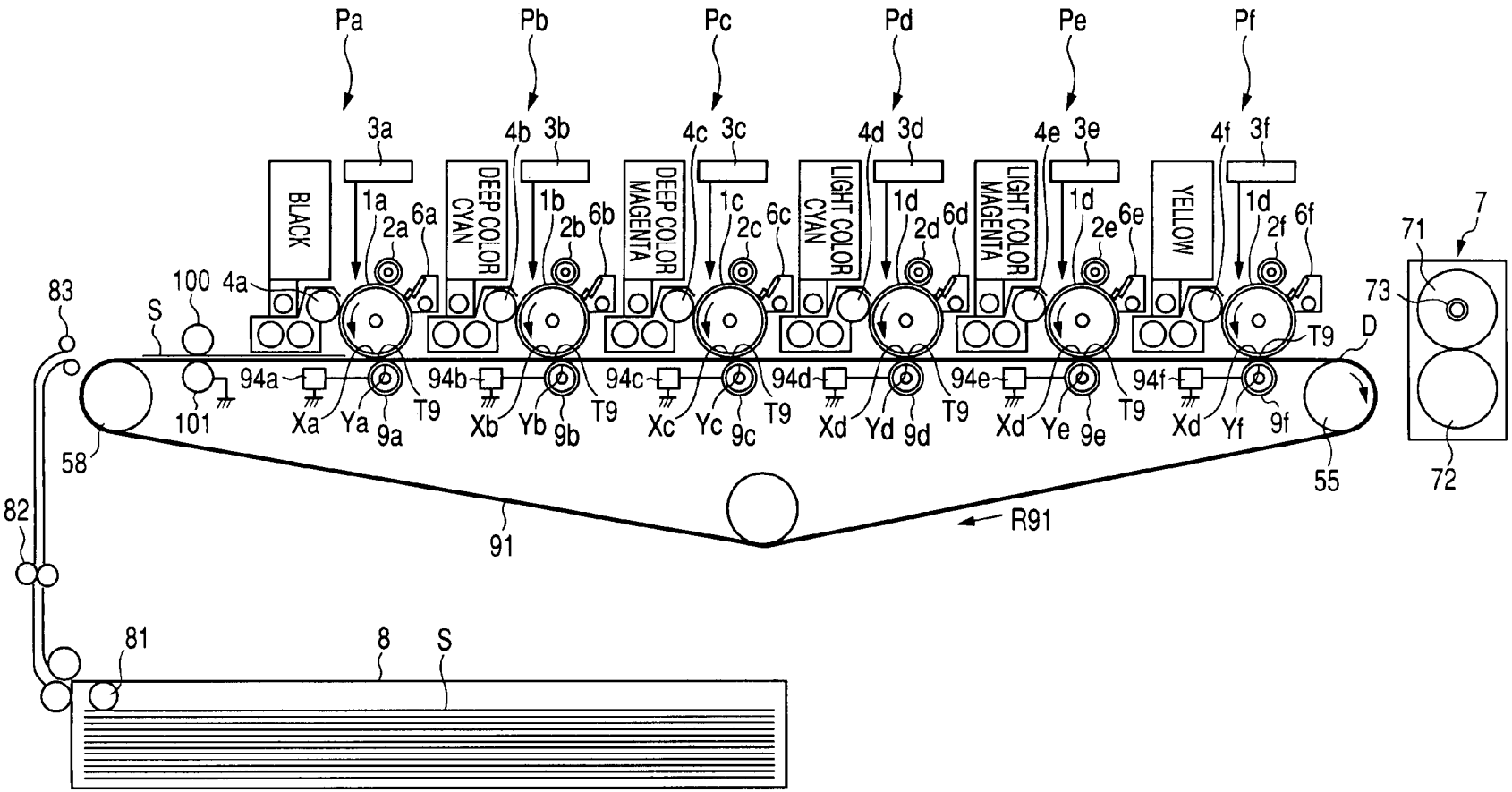
FIG. 12 schematically shows the construction of an image forming apparatus according to a fifth embodiment of the present invention.

FIG. 12 shows an image forming apparatus according to a fifth embodiment. The image forming apparatus shown in FIG. 12 uses a recording material S as a transferring medium. Further, this image forming apparatus has a transfer belt 91 as a recording material carrying member carrying the recording material thereon.

The image forming apparatus shown in FIG. 12, like the image forming apparatus of FIG. 1, has process units for forming black (K), deep color cyan (CH), deep color magenta (MH), light color cyan (CL), light color magenta (ML) and yellow (Y) toner images in the order of first to sixth process units Pa to Pf.

The process in which toner images are formed on photosensitive drums 1*a*, 1*b*, 1*c*, 1*d*, 1*e* and 1*f* is the same as that in the image forming apparatus of FIG. 1. Accordingly, members similar in construction and action to the members of the image forming apparatus of FIG. 1 are given the same reference characters and need not be described.

The recording material contained in a sheet supplying cassette 8 is conveyed by conveying rollers 82, and is further supplied to a transfer belt 91 rotated in the direction of arrow R91, at predetermined timing by registration rollers 83. The recording material S supplied to the transfer belt 91 is electrostatically adsorbed to the transfer belt 91 by an adsorbing roller 100 to which a bias has been applied from a bias voltage source, not shown, and an adsorbing opposed roller 101 disposed at a location opposed thereto with the transfer belt 91 interposed therebetween. At this time, the adsorbing opposed roller 101 is grounded.

A transfer roller 9 is disposed below the photosensitive drum 1. A bias is applied to the transfer roller 9 (transfer member) by a voltage source 94.

The transfer roller 9 has its opposite end portions biased toward the photosensitive drum 1 by an urging member (not shown) such as a spring. Thereby, the transfer roller 9 is brought into pressure contact with the transfer belt and the surface of the photosensitive drum 1 with a predetermined pressure force with the recording material S interposed therebetween, and a transferring portion (transferring nip portion) T9 is formed between the photosensitive drum 1 and the recording material S. The transfer belt 91 and the recording material S are nipped in the transferring portion T9, and a transferring bias voltage opposite in polarity to the polarity of the toner is applied to the transfer roller 9 by the voltage source 94. Thereby, the toner image on the photosensitive drum 1 is transferred to the surface of the recording material S.

The photosensitive drum 1 after the transfer of the toner image has any adhering substances such as the residual toner thereon removed by a cleaning apparatus 6.

In this manner, the toner images formed on the photosensitive drums 1*a*, 1*b*, 1*c*, 1*d*, 1*e* and 1*f* are successively transferred to the recording material S.

The recording material S to which the transfer has been completed is separated from the transfer belt in the separating portion D of the transfer belt 91, and is conveyed to the fixing apparatus 7.

The fixing apparatus 7 has a rotatably disposed fixing roller 71 and a pressure roller 72 rotated while being in pressure contact with the fixing roller 71. A heater 73 such as a halogen lamp is disposed in the interior of the fixing roller 71, and a voltage or the like to the heater 73 is controlled to thereby effect the control of the surface temperature of the fixing roller 71. When in this state, the recording material S is conveyed to the fixing apparatus, the fixing roller 71 and the pressure roller 72 are rotated at a constant speed, and the recording material S, when it passes between the fixing roller 71 and the pressure roller 72, is pressurized and heated from its front and rear surfaces at substantially constant pressure and temperature, whereby the unfixed toner images on the surface of the recording material are fused and fixed, and a full-color image is formed on the recording material S.

The transfer belt 91, like the intermediate transfer belt 51, is formed of dielectric resin such as PC, PET or PVD. In the present embodiment, there is adopted PI resin having volume resistivity of $10^8\Omega\cdot$cm (use was made of a probe conforming to JIS-K6911 method, applied voltage 100V, application time 60 sec., 23° C. 50% RH), and a thickness t=100 μm, but use may be made of other material having other volume resistivity and other thickness.

Also, as the transfer roller 9, use is made of a member of the same construction as the primary transfer roller 5.

Description will now be made of the setting of the transfer member which is a characteristic portion of the present invention.

Again in the image forming apparatus of FIG. 12, as in the image forming apparatus of FIG. 1, regarding black, deep color cyan and deep color magenta of which the brightness is lower than 50, the transfer rollers 9*a*, 9*b* and 9*c* for transferring toner images of these colors to the recording material S are installed downstream. In the embodiment of FIG. 12, the transfer rollers 9*a*, 9*b* and 9*c* are disposed at locations 2 mm downstream of the locations beneath the photosensitive drums 1*a*, 1*b* and 1*c* along the direction of rotation of the transfer belt 91.

The black, deep color cyan and deep color magenta process units Pa, Pb and Pc themselves are disposed more upstream (at the left in FIG. 12) with respect to the direction of rotation of the intermediate transfer belt 51 than the other light color cyan, light color magenta and yellow process units Pd, Pe and Pf.

On the other hand, regarding light color cyan, light color magenta and yellow of which the brightness is higher than 50, the transfer rollers 5 for transferring toner images of these colors to the recording material S are installed relatively upstream to thereby realize the setting for expediting discharge upstream of the respective transferring portions T9, and suppressing "re-transferring". In the embodiment of FIG. 12, the transfer roller 9 is disposed at a location beneath the photosensitive drum 1. The light color cyan, light color magenta and yellow process units Pd, Pe and Pf themselves are disposed more downstream (at the right in FIG. 12) with respect to the direction of rotation of the transfer belt 91 than the other black, deep color cyan and deep color magenta process units Pa, Pb and Pc. Images formed by the present process units suffer from the occurrence of the "scattering" phenomenon during transfer, but from the relation of the aforedescribed degree of permissibility of brightness and scattering, regarding these colors, "scattering" does not visually pose any problem.

As described above, according to the present invention, the set condition of the transfer member, in the present embodiment, the position of the transfer roller 9, is changed in conformity with the brightness of the toner. That is, the position of the transfer roller 9 relative to the photosensitive drum 1 in the direction of movement of the transfer belt 91 is more upstream in the case of yellow, light color magenta and light color cyan of which the brightness of the toner is equal to or greater than 50 than in the case of black, deep color cyan and deep color magenta of which the brightness of the toner is less than 50.

More particularly, the central position Y of an area in which the transfer roller 9 and the recording material S contact with each other relative to the central position X of an area in which the photosensitive drum 1 and the recording material S contact with each other in the direction of movement of the intermediate transfer belt 51 is more upstream in the case of yellow, light color magenta and light color cyan of which the brightness of the toner is equal to or greater than 50 than in the case of black, deep color cyan and deep color magenta of which the brightness of the toner is less than 50.

Thereby, it has become possible to prevent re-transferring and scattering, and the lowering of the quality of image could be prevented.

In the above-described image forming apparatus, toners of six colors are used, but even in an image forming apparatus using toners of four colors, i.e., black (K), deep color cyan (CH), deep color magenta (MH) and yellow, a similar effect can be obtained by changing the position of the transfer member in conformity with the brightness of the toner of the toner image to be transferred.

Figure 13:
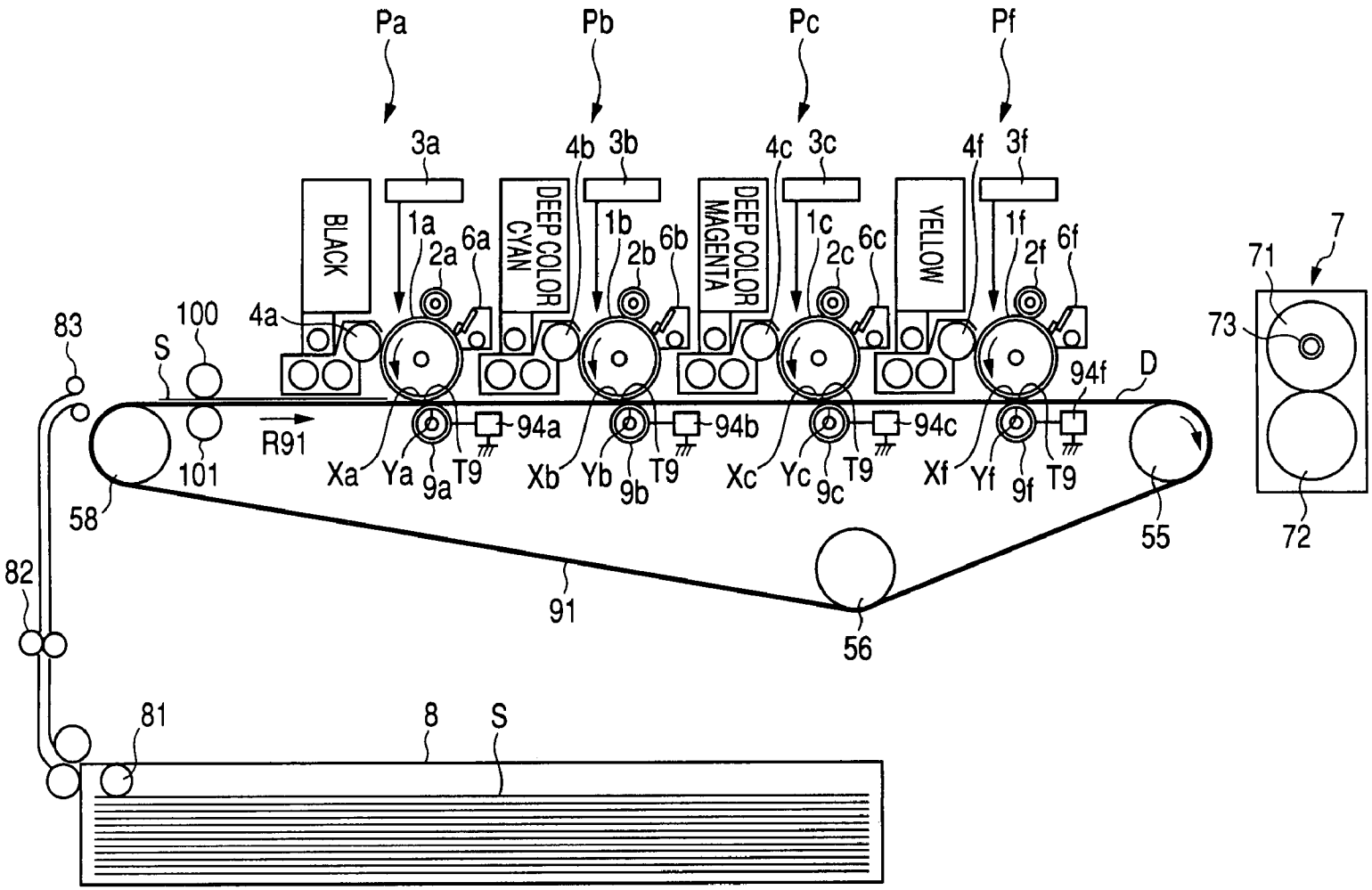
FIG. 13 schematically shows the construction of an image forming apparatus having four developing devices in the fifth embodiment.

FIG. 13 shows the image forming apparatus using toners of four colors i.e., black (K), deep color cyan (CH), deep color magenta (MH) and yellow. The image forming apparatus of FIG. 13 effects image forming by a method similar to that of the image forming apparatus shown in FIG. 12 with the exception that the number of developing devices is four, and the frequency with which the toner images on the photosensitive drums 1 are transferred to the recording material S decreases. Also, in the image forming apparatus of FIG. 13, members similar in construction and action to those in FIG. 12 are given the same reference characters.

<Sixth Embodiment>

Figure 14:
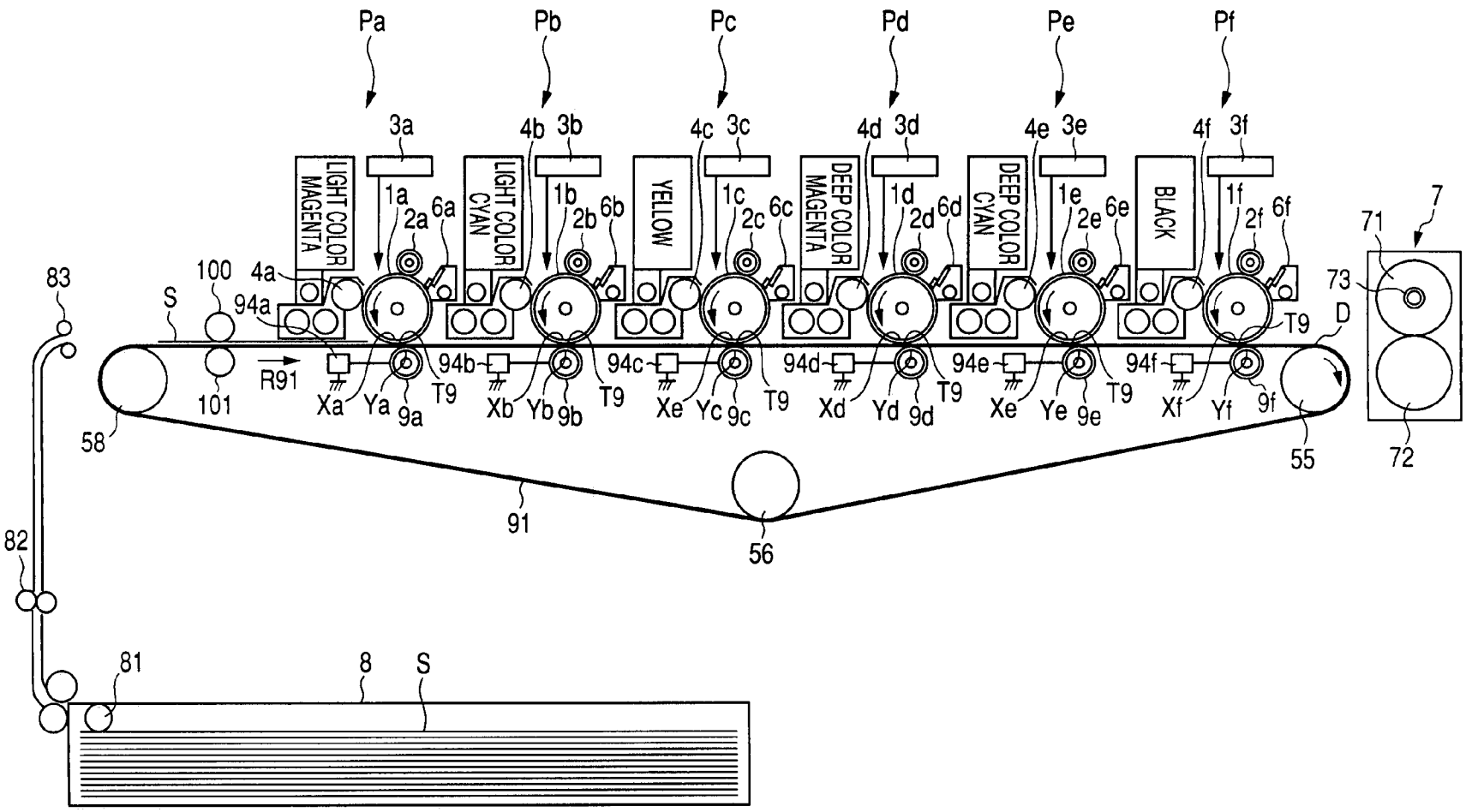
FIG. 14 schematically shows the construction of an image forming apparatus according to a sixth embodiment of the present invention.

An image forming apparatus according to this embodiment is similar in construction to the image forming apparatus shown in the above-described embodiment 5 (see FIG. 12) with the exception that the order of arrangement of the process units along the direction of rotation of the transfer belt 91 differs as shown in FIG. 14. Accordingly, the details of the construction and operation of the image forming apparatus need not be described.

The present embodiment adopts such an arrangement of the process unit as can make the time from after the operation has been started until printing is completed shortest in a case where image forming is effected by the use of four colors, i.e., yellow, deep color magenta, deep color cyan and black used when forming a popular four-color full-color image.

As shown in FIG. 14, first to sixth process units Pa to Pf disposed in succession from the upstream side along the direction of rotation (the direction of arrow 91) of the transfer belt 91 are arranged in the order of the light color magenta, light color cyan, yellow, deep color magenta, deep color cyan and black process units. By adopting such an arrangement, the transfer belt 91 can form an image by the shortest distance of movement in a case where image forming is effected by the use of only four colors, i.e., yellow, deep color magenta, deep color cyan and black, and a case where image forming is effected by the use of black only.

In the present embodiment, regarding light color magenta, deep color magenta, deep color cyan and black, the transfer rollers 9 (9*a* to 9*f*) are located 2 mm downstream of the positions beneath the photosensitive drums 1 with respect to the direction of rotation of the transfer belt 91. Light color magenta, as described in the first embodiment, is high in brightness and therefore need not avoid the "scattering" phenomenon, but yet the process unit therefore is an upstream process unit and therefore does not suffer from the occurrence of "re-transferring", thus adopting a construction for avoiding "scattering".

On the other hand, regarding light color cyan and yellow, in order to avoid "re-transferring", the transfer rollers 9, i.e., the transfer rollers 9*b* and 9*c*, are located beneath the photosensitive drums 1, and in the transferring portion T9 for light color cyan, the re-transferring of light color magenta of the transfer belt 91 can be avoided, and in the primary transferring portion T9 for yellow, the re-transferring of light color magenta and light color cyan can be avoided.

Thus, according to the sixth embodiment of the present invention, when in an image forming apparatus using deep color and light color toners, image forming was to be effected by the use of deep color toners only, the shortest printing time could be achieved and at the same time, re-transferring and scattering could be suppressed to thereby suppress the lowering of the quality of image.

In the above-described image forming apparatus, toners of six colors are used, but even in an image forming apparatus using toners of four colors, i.e., black (K), deep color cyan (CH), deep color magenta (MH) and yellow, the position of the transfer member was changed in conformity with the brightness of the toner of the toner image to be transferred, whereby when image forming was effected by the use of black only, the shortest printing time could be achieved and also, re-transferring and scattering could be suppressed to thereby suppress the lowering of the quality of image.

Figure 15:
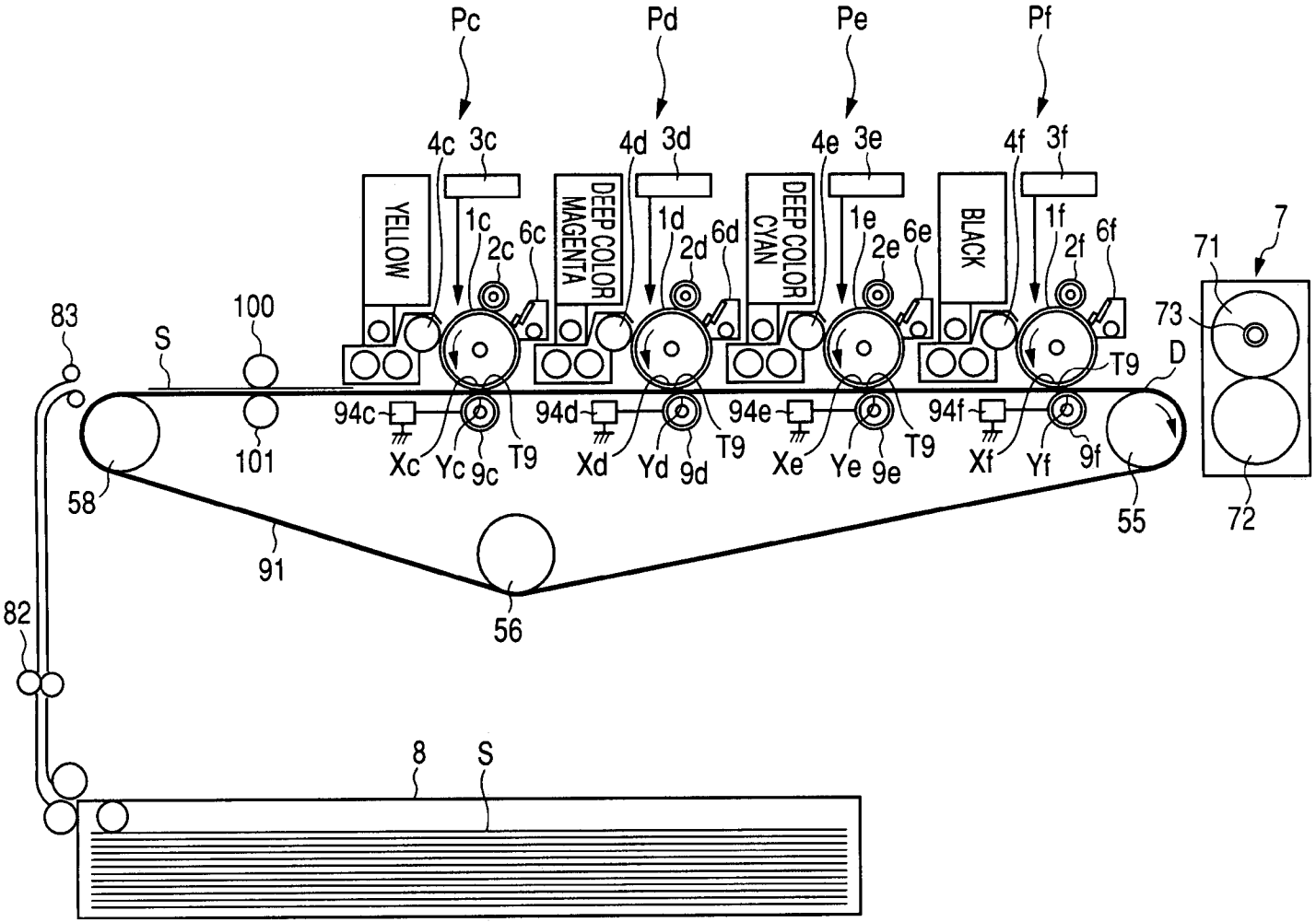
FIG. 15 schematically shows the construction of an image forming apparatus having four developing devices in the sixth embodiment.

FIG. 15 shows the image forming apparatus using toners of four colors, i.e., black (K), deep color cyan (CH), deep color magenta (MH) and yellow. The image forming apparatus of FIG. 15 effects image forming by a method similar to that of the image forming apparatus shown in FIG. 14 with the exception that the number of developing devices is four, and the frequency with which the toner images on the photosensitive drums 1 are transferred to the recording material S decreases.

In the image forming apparatus of FIG. 15, members similar in construction and action to those in FIG. 14 are given the same reference characters.

<Seventh Embodiment>

Figure 16:
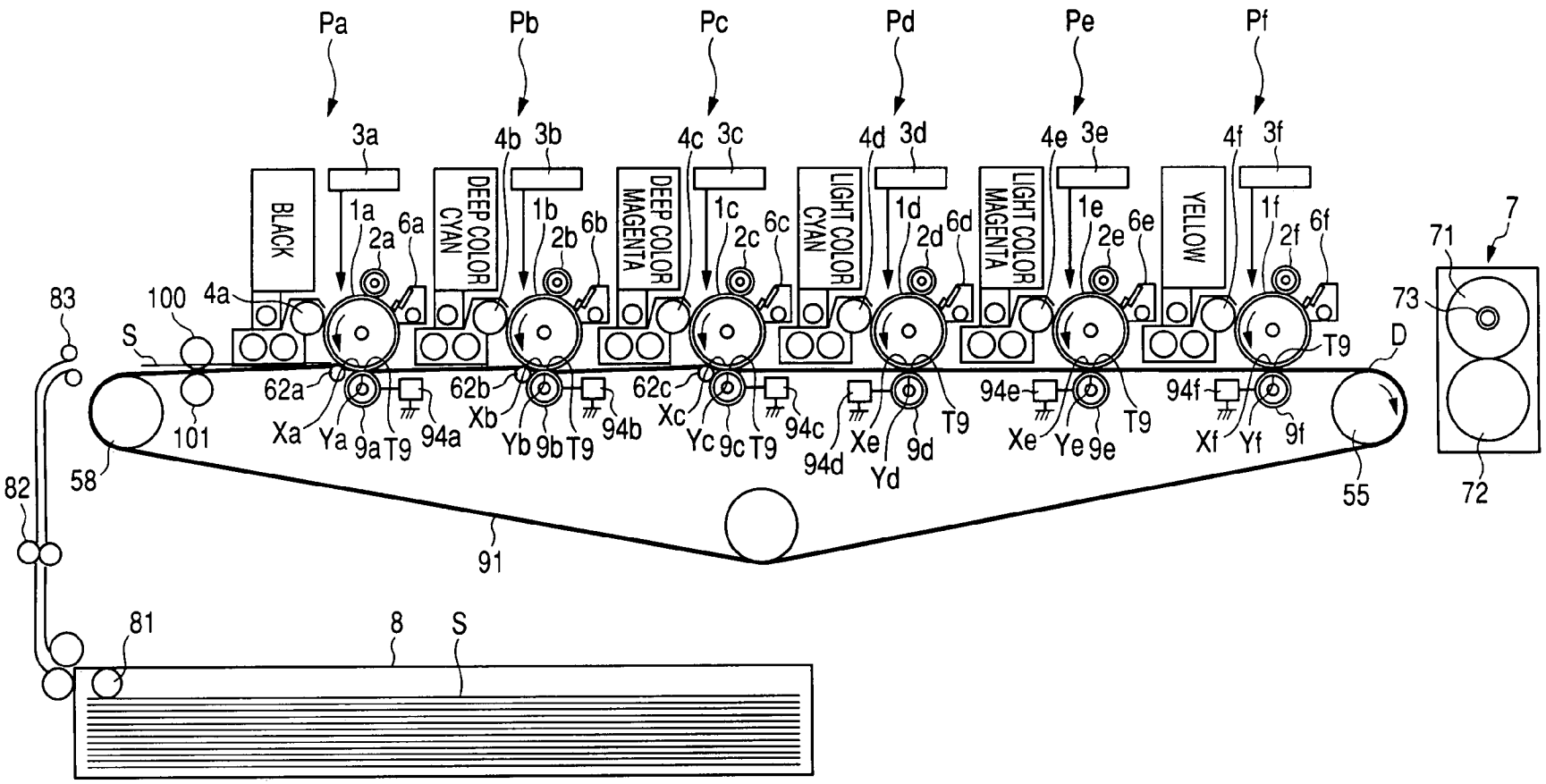
FIG. 16 schematically shows the construction of an image forming apparatus according to a seventh embodiment of the present invention.

An image forming apparatus according to this embodiment differs from the image forming apparatus of the aforedescribed fifth embodiment shown in FIG. 12 in that as shown in FIG. 16, push-up members 62*a*, 62*b* and 62*c* are provided upstream of the transferring portions T9 of the first, second and third process units Pa, Pb and Pc, respectively.

That is, as the condition of the transfer member, the position of the primary transfer roller 5 is not changed, but the push-up members 62*a*, 62*b* and 62*c* are provided as described above.

The image forming apparatus shown in FIG. 16, like that of the fifth embodiment, has six process units (first to sixth process units Pa to Pf) in succession from the upstream side along the direction of rotation of the transfer belt 91. These first to sixth process units Pa to Pf, in the named order, are process units of respective colors, i.e., black, deep color cyan, deep color magenta, light color cyan, light color magenta and yellow. The process units Pa, Pb and Pc of black, deep color cyan and deep color magenta of which the brightness is low are provided with the push-up rollers 62*a*, 62*b* and 62*c* upstream of the transfer rollers 9*a*, 9*b* and 9*c* as transfer members. These push-up rollers are for bringing the photosensitive drums 1*a*, 1*b* and 1*c* and the transfer belt 91 into close contact with each other before the transfer belt 91 receives the influence of electric fields from the primary transfer rollers 9*a*, 9*b* and 9*c*. Regarding light color cyan, light color magenta and yellow of which the brightness is high, the transfer rollers 9*d*, 9*e* and 9*f* are disposed at locations beneath the photosensitive drums 1 as in the fifth embodiment. As a result, discharge upstream of the primary transferring portion T1 is expedited and "re-transferring" is suppressed.

As described above, in the present invention, the set condition of the transfer member, in the present embodiment, the shape of the nip of the transfer roller 9 near the transferring portion T9 is changed in conformity with the brightness of the toner. More particularly, the central position Y of an area in which the transfer roller 9 and the transfer belt 91 contact with each other relative to the central position X of an area in which the photosensitive drum 1 and the intermediate transfer belt 51 in the direction of movement of the transfer belt 91 is more upstream in the case of yellow, light color magenta and light color cyan of which the brightness of the toner is equal to or greater than 50 than in the case of black, deep color cyan and deep color magenta of which the brightness of the toner is less than 50.

Thereby, it has become possible to prevent re-transferring and scattering at a time, and the lowering of the quality of image could be prevented.

In the above-described image forming apparatus, toners of six colors are used, but even in a case where toners of four colors, i.e., black (K), deep color cyan (CH), deep color magenta (MH) and yellow, are used, a similar effect can be obtained by changing the shape of the nip of the transfer roller 9 near the transferring portion T9.

Figure 17:
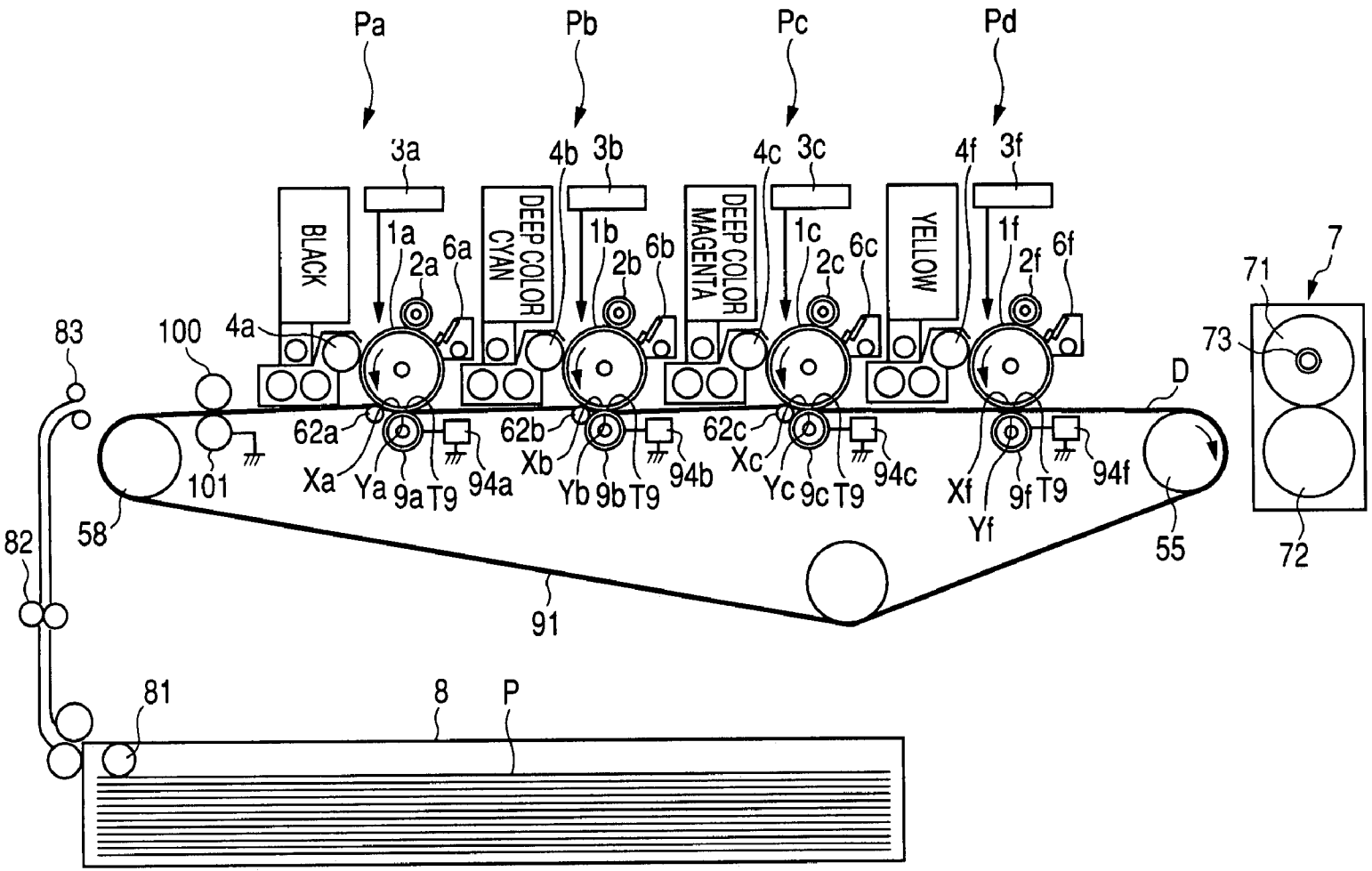
FIG. 17 schematically shows the construction of an image forming apparatus having four developing devices in the seventh embodiment.
Figure 18:
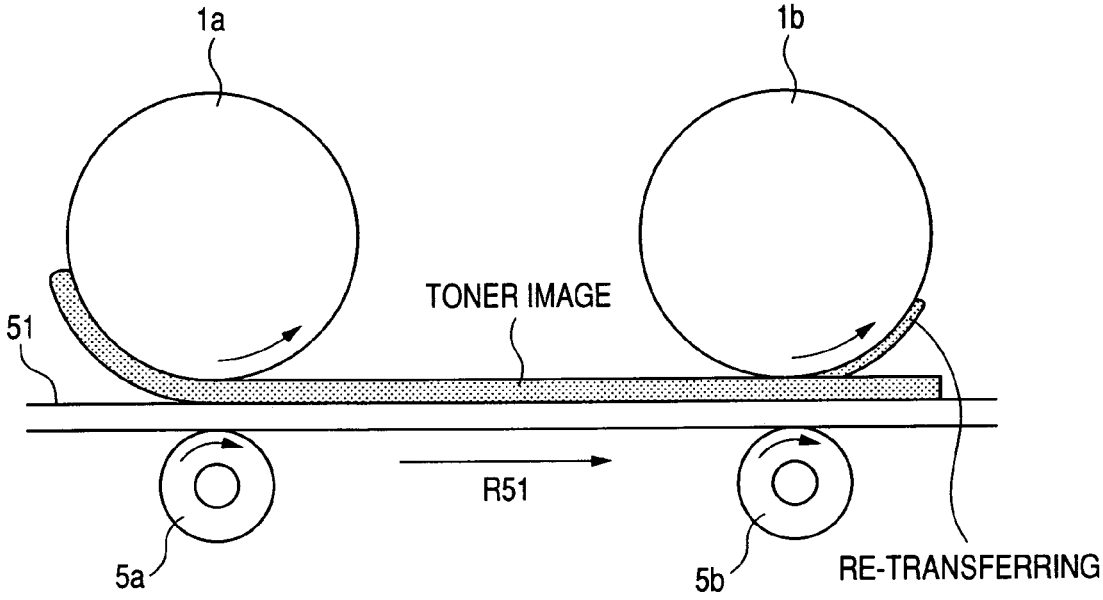
FIGS. 18 and 19 are typical views illustrating re-transferring.
Figure 19:
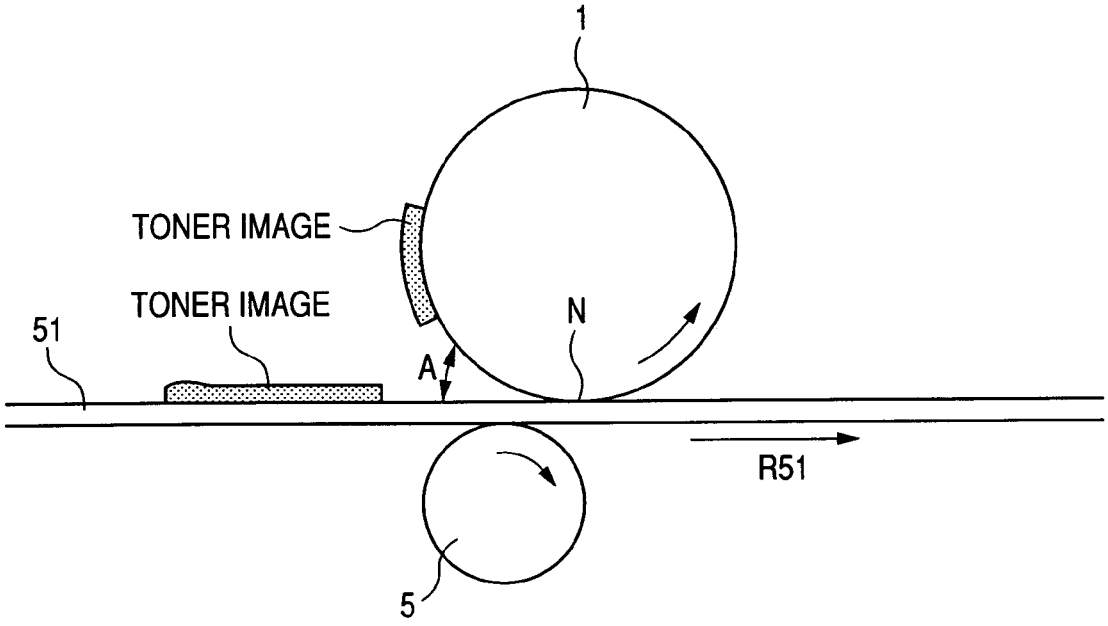

FIG. 17 shows an image forming apparatus using toners of four colors, i.e., black (K), deep color cyan (CH), deep color magenta (MH) and yellow. The image forming apparatus of FIG. 17 effects image forming by a method similar to that of the image forming apparatus shown in FIG. 16 with the exception that the number of developing devices 4 is four, and the frequency with which the toner images on the photosensitive drums 1 are transferred to the recording material S decreases.

Also, in the image forming apparatus of FIG. 17, members similar in construction and action to those in FIG. 16 are given the same reference characters.

This application claims priority from Japanese Patent Application No. 2003-428476 filed on Dec. 24, 2003, which is hereby incorporated by reference herein.

What is claimed is:

1. An image forming apparatus comprising:

light color toner image forming means for forming a light color toner image on a transferring medium with a light color toner, said light color toner image forming means including:

a first image bearing member;

a first developing device for developing an electrostatic image on said first image bearing member in a first developing portion to form the light color toner image on said first image bearing member; and a first transferring member for electrostatically transferring the light color toner image to the transferring medium by abutting against said first image bearing member through the transferring medium at a first abutment portion; and deep color toner image forming means for forming a deep color toner image on the transferring medium with a deep color toner having a same hue as the light color toner and having a brightness less than a brightness of the light color toner, said deep color toner image forming means including:

a second image bearing member;

a second developing device for developing an electrostatic image on said second image bearing member in a second developing portion to form the deep color toner image on said second image bearing member; and a second transferring member for electrostatically transferring the deep color toner image to the transferring medium by abutting against said second image bearing member through the transferring medium at a second abutment portion, said second transferring member being arranged so that a distance in a rotational direction of said second image bearing member between said second developing portion and said second abutment portion is longer than a distance in a rotational direction of said first image bearing member between said first developing portion and said first abutment portion, and said deep color toner image forming means is arranged upstream of a direction of movement of said transferring medium with respect to said light color toner image forming means.

2. An image forming apparatus according to claim 1, wherein a brightness of the deep color toner is less than 50 and a brightness of the light color toner is greater than 50, wherein a level of brightness is obtained by measuring a toner on a recording material by a "Gretagmacbeth Macbeth Color Spectrolino" in a condition of a D50 light source at an incidence angle of zero degrees and a reflection angle of 45 degrees.

3. An image forming apparatus according to claim 1, wherein the transferring medium is an intermediate transferring member for bearing temporally a toner image.

4. An image forming apparatus according to claim 1, wherein the transferring medium is a recording material.

5. An image forming apparatus comprising:

an image bearing member;

developing means for developing a electrostatic image on said image bearing member in a developing portion to form a light color toner image with a light color toner and a deep color toner image with a deep color toner having a same hue as the light color toner and having a brightness less than a brightness of the light color toner;

a transferring member, abutted to said image bearing member through a transferring medium at an abutment portion, for electrostatically transferring the deep color toner image and the light color toner image to the transferring medium, said transferring member transferring the light color toner image to the transferring medium bearing the deep color toner image; and movable means for moving the transferring medium in a manner that a distance between said developing portion and said abutment portion in a rotational direction of said image bearing member when the deep color toner image is transferred is longer than the distance when the light color toner image is transferred.

6. An image forming apparatus according to claim 5, wherein a brightness of the deep color toner is less than 50, wherein a level of brightness is obtained by measuring a toner on a recording material by a "Gretagmacbeth Macbeth Color Spectrolino" in a condition of a D50 light source at an incidence angle of zero degrees and a reflection angle of 45 degrees.

7. An image forming apparatus according to claim 5, wherein the transferring medium is an intermediate transferring member for bearing temporally a toner image.

8. An image forming apparatus comprising, light color toner image forming means for forming a light color toner image on a transferring medium with a light color toner, said light color toner image forming means including:

a first image bearing member for bearing and rotating the light color toner image; and a first transferring member for transferring the light color toner image to the transferring medium in a first area where said first image bearing member and the transferring medium contact with each other, via a bias applied by abutting against said first image bearing member through the transferring medium at a first abutment portion; and deep color toner image forming means for forming a deep color toner image with a deep color toner having a same hue as the light color toner and having a brightness less than a brightness of the light color toner on the transferring medium, said deep color toner image forming means including:

a second image bearing member for bearing and rotating the deep color toner image; and a second transferring member for transferring the deep color toner image to the transferring member in a second area where said second image bearing member and said second transferring member contact with each other, via a bias applied while abutting against said second image bearing member through the transferring medium at a second abutment portion, said second transferring member being arranged so that, in a direction of movement of the transferring medium, a distance between an uppermost stream position of the second area and said second abutment portion is longer than a distance between an uppermost stream position of the first area and said first abutment portion, and said deep color toner image forming means is arranged upstream of said light color toner image forming means.

9. An image forming apparatus according to claim 8, wherein brightness of said deep color toner is less than 50 and a brightness of light color toner is greater than 50, wherein a level of brightness is obtained by measuring a toner on a recording material by a "Gretagmacbeth Macbeth Color Spectrolino" in a condition of a D50 light source at an incidence angle of zero degrees and a reflection angle of 45 degrees.

10. An image forming apparatus according to claim 8, wherein the transferring medium is an intermediate transferring member for bearing temporally a toner image.

11. An image forming apparatus according to claim 8, wherein the transferring medium is a recording material.

12. An image forming apparatus comprising:

an image bearing member for bearing and rotating a light color toner image formed by a light color toner and a deep color toner image formed by a deep color toner, the deep color toner image having a same hue as the light color toner, the deep color toner having a brightness less than a brightness of the light color toner;

a transferring member for transferring the deep color toner image and the light color toner image to a transferring medium in an area where said image bearing member and the transferring medium contact with each other, via a bias applied while abutting against said image bearing member through the transferring medium at an abutment portion, said transferring member transferring the light color toner image to the transferring medium bearing the deep color toner image; and movable means for moving the transferring medium in such a manner that a distance between an uppermost stream position of the area wherein said image bearing member and the transfer medium contact each other and said abutment portion in a moving direction of the transferring medium when the deep color toner image is transferred is longer than the distance when the light color toner image is transferred.

13. An image forming apparatus according to claim 12, wherein the brightness of the deep color toner is less than 50, and wherein a level of brightness is obtained by measuring a toner on a recording material by a "Gretagmacbeth Macbeth Color Spectrolino" in a condition of a D50 light source at an incidence angle of zero degrees and a reflection angle of 45 degrees.

14. An image forming apparatus according to claim 12, wherein the transferring medium is an intermediate transferring member for bearing temporally a toner image.

* * * * *

UNITED STATES PATENT AND TRADEMARK OFFICE

CERTIFICATE OF CORRECTION

PATENT NO. : 7,130,568 B2
APPLICATION NO. : 11/011169
DATED : October 31, 2006
INVENTOR(S) : Jun Mochizuki It is certified that error appears in the above-identified patent and that said Letters Patent is hereby corrected as shown below:

ON THE TITLE PAGE, AT ITEM (54), Title:
"PRESENTS" should read --PREVENTS--.

ON THE TITLE PAGE, AT ITEM (56), RC:
Foreign Patent Documents, "JP 9-152971 6/1997" should read --JP 9-152791 6/1997--.

ON THE TITLE PAGE, AT ITEM (57), Abstract:
Line 1, "Image" should read --image--.
Line 20, "potion" should read --portion--.
Line 23, "potion" should read --portion--.

COLUMN 1:
Line 2, "PRESENTS" should read --PREVENTS--.
Line 32, "transferring," should read --transferring--.
Line 42, "more becomes" should read --greater--.

COLUMN 2:
Line 36, "member" (second occurrence) should read --member is--.

COLUMN 4:
Line 35, "units p" should read --unit p--.

COLUMN 7:
Line 37, "permissibly," should read --permissible,--.

UNITED STATES PATENT AND TRADEMARK OFFICE

CERTIFICATE OF CORRECTION

PATENT NO. : 7,130,568 B2
APPLICATION NO. : 11/011169
DATED : October 31, 2006
INVENTOR(S) : Jun Mochizuki It is certified that error appears in the above-identified patent and that said Letters Patent is hereby corrected as shown below:

COLUMN 19:
Line 26, "a" should read --an--.
Line 56, "comprising," should read --comprising:--.

Signed and Sealed this

Twenty-fourth Day of April, 2007

JON W. DUDAS
*Director of the United States Patent and Trademark Office*